US008309871B2

(12) United States Patent
Dupraz et al.

(10) Patent No.: US 8,309,871 B2
(45) Date of Patent: Nov. 13, 2012

(54) APPARATUS FOR CONTROLLING ELECTRICAL SWITCHGEAR

(75) Inventors: Jean-Pierre Dupraz, Bressolles (FR); Michel Collet, Lyons (FR); Olivier Grejon, Parcieux (FR); Xavier Allaire, Chassieu (FR); Georges Doummar, Lyons (FR); Philippe Manin, Lyons (FR)

(73) Assignee: Areva T&D SA, Paris la Defense Cedex (FR)

( * ) Notice: Subject to any disclaimer, the term of this patent is extended or adjusted under 35 U.S.C. 154(b) by 358 days.

(21) Appl. No.: 12/445,932

(22) PCT Filed: Oct. 16, 2007

(86) PCT No.: PCT/EP2007/061022

§ 371 (c)(1), (2), (4) Date: Sep. 21, 2010

(87) PCT Pub. No.: WO2008/046823

PCT Pub. Date: Apr. 24, 2008

(65) Prior Publication Data

US 2011/0005906 A1 Jan. 13, 2011

(30) Foreign Application Priority Data

Oct. 18, 2006 (FR) ..... 06 09128

(51) Int. Cl.
*H01H 5/00* (2006.01)

(52) U.S. Cl. ..... 200/400; 218/154

(58) Field of Classification Search ..... 200/400, 200/401, 500, 501, 318, 323–325, 329, 337; 218/153, 154

See application file for complete search history.

(56) References Cited

U.S. PATENT DOCUMENTS 5,280,258 A * 1/1994 Opperthauser ..... 335/172
5,584,383 A * 12/1996 Matsuo et al. ..... 200/400
6,180,902 B1 * 1/2001 Kowalyshen et al. ..... 200/400
6,355,898 B1 * 3/2002 Gimeno et al. ..... 218/154

(Continued)

FOREIGN PATENT DOCUMENTS

EP 0788126 A1 8/1997

(Continued)

OTHER PUBLICATIONS

International Search Report, PCT/EP2007/061022, mailed Feb. 1, 2008.

*Primary Examiner* — Michael Friedhofer
(74) *Attorney, Agent, or Firm* — Nixon Peabody LLP

(57) ABSTRACT

A control apparatus for controlling electrical switchgear, the control apparatus being designed such that it is capable of performing the following in succession:

during an opening stage for opening the moving contact, causing the connection end for connection to the moving contact and provided on an output member to go from the point P1 to the point P2, under the effect of an opening mechanical spring moving a moving abutment element that drives the output member by abutment;

during a re-cocking stage for re-cocking the spring, moving the moving abutment element under the effect of switching on a motor, while keeping the connection end at the point P2; and during a closure stage for closing the moving contact, causing the connection end to go from the point P2 to the point P1, also under the effect of switching on the motor.

27 Claims, 20 Drawing Sheets

U.S. PATENT DOCUMENTS

| | | | | |
|---|---|---|---|---|
| 6,563,067 | B2 * | 5/2003 | Ohtsuka et al. | 200/400 |
| 6,917,006 | B2 * | 7/2005 | Bachofen | 200/400 |
| 7,009,130 | B2 * | 3/2006 | Hashimoto et al. | 200/400 |
| 7,880,104 | B2 * | 2/2011 | Grieshaber et al. | 200/400 |
| 2004/0262141 | A1 * | 12/2004 | Bachofen | 200/400 |
| 2007/0163869 | A1 * | 7/2007 | Courbon et al. | 200/400 |
| 2008/0296137 | A1 * | 12/2008 | Chen et al. | 200/400 |

FOREIGN PATENT DOCUMENTS

| | | | |
|---|---|---|---|
| EP | 0801406 | A1 | 10/1997 |

* cited by examiner

APPARATUS FOR CONTROLLING ELECTRICAL SWITCHGEAR

CROSS REFERENCE TO RELATED APPLICATIONS OR PRIORITY CLAIM

This application is a national phase of International Application No. PCT/EP2007/061022, entitled "DEVICE FOR CONTROLLING AN ELECTRICAL APPLIANCE", which was filed on Oct. 16, 2007, and which claims priority of French Patent Application No. 06 09128, filed Oct. 18, 2006.

DESCRIPTION

Technical Field

The present invention relates to apparatus for controlling electrical switchgear that has a moving contact suitable for taking up a closed position and an open position.

The term "electrical switchgear" is used herein to mean, in general, a circuit-breaker, a disconnector, or grounding apparatus. It also includes switchgear that combines these various functions, such as disconnector circuit-breakers.

In the prior art, it is known that apparatus can be implemented that is of the "combined design" or "hybrid design" type, in that such apparatus incorporates both an electric motor and a mechanical spring-loaded system for performing the closure and opening stages for closing and opening the moving contact of the switchgear. The motor then makes it possible, by means of suitable servo-control, to control the various tasks of the electrical switchgear, such as opening and closing its contacts.

Although in widespread use, those solutions suffer from drawbacks such as the drawbacks resulting from the power of the motor and the energy of the spring being used jointly and simultaneously both for opening and for closing the moving contact.

In order to be able to make use of energy from the spring during one of those two stages, it is necessary to cause the spring to accumulate energy during the other stage, and vice versa. This need to involve the mechanical spring during both of the stages thus usually results in employing motors that are over-dimensioned compared with the dimensioning that would suffice to reach the opening and closure speeds that are required for the moving contact.

In addition, that type of combined design for the control apparatus generally involves providing opening and closure strokes for the moving contact that are longer than necessary, thereby making it more complex, heavier, and less compact.

An object of the invention is thus to provide a control device that is simple and reliable for electrical switchgear that is preferably of the medium-voltage type or of the high-voltage type.

To this end, the invention provides control apparatus for controlling electrical switchgear, such as switchgear for interrupting electrical power, that has a moving contact suitable for taking up a closed position and an open position, the control apparatus being designed to move the moving contact, and comprising a stationary frame, and an output member that is mounted to move in translation relative to the stationary frame and that has a connection end for connection to the moving contact, the apparatus further comprising at least one motor and an opening mechanical spring received between an element fastened to the frame and a moving abutment element. In addition, the output member is suitable for taking up a closure position which makes it possible to place the moving contact in its closed position and in which the connection end for connection to the moving contact is situated at a point P1, and an opening position which makes it possible to place the moving contact in its open position and in which the connection end for connection to the moving contact is situated at a point P2 distinct from P1. According to the invention, the control apparatus is designed such that it is capable of performing the following in succession:

during an opening stage for opening the moving contact, causing the connection end for connection to the moving contact to go from the point P1 to the point P2, under the effect of the opening mechanical spring moving the moving abutment element that drives the output member by abutment;

during a re-cocking stage for re-cocking the opening mechanical spring, moving the moving abutment element under the effect of switching on said at least one motor, while keeping the connection end for connection to the moving contact at the point P2; and during a closure stage for closing the moving contact, causing the connection end for connection to the moving contact to go from the point P2 to the point P1, also under the effect of switching on said at least one motor.

The principle of the invention is thus based on a design making it possible to perform three distinct stages in succession, the three stages being referred to as the "opening stage" for opening the moving contact, the "re-cocking stage" for re-cocking the opening spring, and the "closure stage" for closing the moving contact, between the instant at which the moving contact leaves its closed position and the instant at which it returns thereto after taking up its open position. Unlike prior art apparatus, provision is made to perform a re-cocking stage for re-cocking the opening mechanical spring, which stage is distinct from the stages of closing and opening the moving contact, and the opening stage can be driven solely by releasing the energy previously accumulated by the above-mentioned spring. Therefore, throughout the moving contact closure stage, which is complete once said moving contact has reached its closed position, no energy needs to be accumulated by the spring, so that the stroke of the contact is kept fully under control, and requires less energy than the energy required with prior art apparatus. This closure stage can thus be implemented by means of a motor that is of lower power than in the prior art.

In addition, implementing the opening stage is extremely reliable due to the fact that it advantageously does not require the electric motor to be switched on, but rather it can take place automatically merely by releasing energy from the spring as soon as the locking means for locking the moving contact in the closed position have been deactivated.

The re-cocking stage for re-cocking the spring does not generate any movement of the output member or any movement of the moving contact, which then remains in its open position, preferably without the assistance of any locking means, but rather merely by means of the specific design and shape of the control apparatus. The sole purpose of this stage is to accumulate energy in the opening spring, before the contact starts its closure stage during which it is moved towards its closed position. Therefore, it should be understood that the design proposed by the invention makes it possible advantageously to obtain a stroke for the contact that is fully optimized, since said stroke does not go beyond the stroke that is just necessary to go between the open and the closed positions of the moving contact.

In addition, the closure stroke of the moving contact is kept fully under control since it is performed by switching on the motor, and since it does not involve the opening spring which has already been re-cocked sufficiently so that it can subsequently perform the opening stage on its own. Here too, due to the fact that there is no need to involve the spring during the closure stage, the power required for moving the moving contact at the desired speed to its closed position is lower than the power required in prior art apparatus, so that the motor used can therefore be of lower power and thus of lower cost.

Preferably, as mentioned above, the control apparatus is designed so that, during the closure stage for closing the moving contact, resulting in the connection end for connection to the moving contact moving from the point P2 to the point P1, the energy stored in the opening mechanical spring does not vary, i.e. said mechanical spring does not release or accumulate energy during this stage.

It is however indicated that the apparatus could be designed so that the opening spring performs the function of braking the end of the closure stage of the moving contact, by the spring being stressed due to the output member moving. However, an auxiliary spring can be provided for performing this function, optionally in combination with the opening spring. As described in the detailed description of a preferred embodiment, provision can also be made for the opening spring to be stressed to a small extent at the end of the closure stage of the moving contact, in order to allow the moving abutment element to move to a small extent, thereby enabling it to be released from the system for holding it in the re-cocked position.

Preferably, the apparatus is designed so that the opening stage for opening the moving contact, resulting in the connection end for connection to the moving contact moving from the point P1 to point P2, is performed solely under the effect of the opening mechanical spring, so as to obtain very good reliability. Alternatively, the opening stage of the moving contact could be performed by means of an auxiliary spring for absorbing the shock of the end of the closure stroke of the output member, without going beyond the ambit of the invention.

Preferably, the apparatus further comprises first transmission means interposed between said at least one motor and the moving abutment element, said first transmission means comprising at least one transmission assembly provided with a drive abutment organized to be moved along a closed line, the closed line having an active portion along which the drive abutment is capable of driving a follower abutment secured to the moving abutment element for the purpose of bringing the moving abutment element from a relaxed position to a re-cocked position, and a passive portion along which the drive abutment, since it not longer acts on the associated follower abutment, allows the moving abutment element to go from the re-cocked position to the relaxed position. Thus, the advantage resulting from such a configuration lies in the fact that, during the opening stage of the moving contact, the first transmission means do not generate any opposing inertia force opposing the movement of the moving element that drives the output member by abutment to its opening position.

This transmission assembly further comprises a chain or a belt carrying the drive abutment and following the closed line, the chain or belt being arranged between two wheels, at least one of which is driven in rotation by said at least one motor.

In this configuration, the transmission assembly further comprises a drive abutment support track engaged closely by the drive abutment carried by the chain or belt.

The drive abutment support track is provided with a setback into which the drive abutment mounted to be free to pivot on the chain or belt is designed to retract automatically by pivoting, when the drive abutment leaves the active portion of the closed line. It is then possible to make provision for the apparatus to be designed so that the drive abutment retracts automatically into the setback by the follower abutment bearing against the drive abutment, thereby tending to cause the drive abutment to pivot about its pivot axis relative to the chain or belt.

Naturally, a plurality of identical or similar transmission assemblies can equip the first transmission means, said assemblies then preferably being driven by a common drive shaft connected to a single motor. In which case, the drive abutments mounted to pivot on their respective chains/belts are organized so as to move in phase with one another.

Preferably, the follower abutment is arranged at the end of a rod whose other end is secured to said moving abutment element. Thus, two transmission assemblies are preferably provided that co-operate with respective ones of the rods secured to the moving abutment element, which rods can be placed on either side of the output member. In addition, provision is made for said rods to be disposed parallel to the axis along which the output member moves in translation relative to the stationary frame, and thus parallel to the output member which is preferably in the form of a connection rod.

In analogous meaner, the control apparatus further comprises second transmission means interposed between said at least one motor and the output member, the second transmission means comprising at least one transmission assembly provided with a drive abutment organized to be moved along a closed line, the closed line having an active portion along which the drive abutment is capable of driving a follower abutment secured to the output member for the purpose of bringing the output member from the opening position to the closure position, and a passive portion along which the drive abutment, since it not longer acts on the associated follower abutment, allows the output member to go from the closure position to the opening position. Thus, the advantage resulting from such a configuration lies in the fact that, during the opening stage of the moving contact, the second transmission means also do not generate any opposing inertia force opposing the movement of the output member as it goes towards its opening position.

Preferably, the transmission assembly further comprises a chain or a belt carrying the drive abutment and following the closed line, the chain or belt being arranged between two wheels, at least one of which is driven in rotation by said at least one motor.

In this configuration, the transmission assembly further comprises a drive abutment support track engaged closely by the drive abutment carried by the chain or belt.

The drive abutment support track is provided with a setback into which the drive abutment mounted to be free to pivot on the chain or belt is designed to retract automatically by pivoting, when the drive abutment leaves the active portion of the closed line.

Here too, it is possible to make provision for the control apparatus to be designed so that the drive abutment retracts automatically into the setback by the follower abutment bearing against the drive abutment, thereby tending to cause the drive abutment to pivot about its pivot axis relative to the chain or belt.

A plurality of identical or similar transmission assemblies can equip the second transmission means, said assemblies then preferably being driven by a common drive shaft connected to a single motor. In which case, the drive abutments mounted to pivot on their respective chains/belts are organized so as to move in phase with one another. For example, two transmission assemblies co-operate with respective ones of two follower abutments secured directly to the output member.

However, provision is preferably made for there to be a single assembly forming said second transmission means.

Thus, a single drive abutment is mounted on a chain, e.g. a double chain, and a single follower abutment is mounted on the output member, such as a separate pin passing through the output member and forming two catches disposed on either side of said output member. In such a configuration, the drive abutment can then be in the form of two side plates between which the output member can be inserted during the closure stage, the two side plates being designed to come into abutment with respective ones of the two above-mentioned catches.

The first and second transmission means are thus driven by said at least one motor, which is preferably constituted by a single motor. Thus, provision is made for the single motor, which is preferably constituted by a servomotor in order to keep good control over the closure stage of the moving contact, to be coupled to a common drive shaft driving each of the transmission assemblies of the first and second transmission means. For this purpose, provision is made for the drive abutments of the first transmission means to be associated with the moving abutment element and for the drive abutment(s) of the second transmission means associated with the output member to be moved in synchronized manner, with a determined phase offset making it possible to perform in succession the three distinct stages of opening the moving contact, of re-cocking the opening mechanical spring, and of closing the moving contact.

Preferably, the control for the motor or for the servomotor is of the pulse width modulation type having variable frequency, so that, between two successive control pulses, the energy is transferred from the source to the motor during a first duration corresponding to a driving stage, and then from the motor to the source during a second duration corresponding to a braking stage, the relative durations of the two stages making it possible to adjust the drive force. In addition, the position of the moving contact is preferably servo-controlled during the closure stage, relative to a setpoint in the form of a mathematical function of time. In addition, the speed of the moving contact is also preferably servo-controlled during the closure stage, relative to a setpoint in the form of a mathematical function of time, and, likewise, the acceleration of the moving contact is servo-controlled during said closure stage, also relative to a setpoint that is in the form of a mathematical function of time.

Preferably, the control device further comprises a system for holding the moving abutment element in the re-cocked position, and a system for holding the output member in the closure position.

With this arrangement, it is possible to make provision for the system for holding the moving abutment element in the re-cocked position to be deactivated at the end of the closure stage of the moving contact. Alternatively, the apparatus may be designed so that the system for holding the moving abutment element in the re-cocked position and the system for holding the output member in the closure position are deactivated substantially simultaneously when the opening stage of the moving contact is initiated.

Or indeed, it is possible to make provision for the system for holding the moving abutment element in the re-cocked position to be deactivated after the output member has reached its closure position, preferably at the very end of the closure stage or just before it, as described below in the even more preferred embodiment of the present invention.

By way of indication, it is specified that mounting the output member to move in translation relative to the stationary frame requires the control apparatus to deliver a linear output movement towards the moving contact.

Preferably, the moving abutment element is mounted to slide relative to the output member which passes through the moving abutment element, along a sliding axis that is identical to the axis along which the output member moves in translation relative to the stationary frame.

In addition, in order to make the apparatus more compact overall, the opening mechanical spring is arranged around the output member.

Preferably, the control apparatus further comprises an auxiliary mechanical spring for absorbing the shock of the end of the closure stroke of the output member, as mentioned above. Analogously, provision is made so that the apparatus further comprises an auxiliary mechanical spring for absorbing the shock of the end of the opening stroke of the output member. In which case, the energy accumulated by this auxiliary spring at the end of the opening stage can be released when necessary in order to facilitate initiation of the subsequent closure stage, which is essentially performed by means of the servomotor.

The invention also provides electrical switchgear having a moving contact suitable for taking up a closed position and an open position, the electrical switchgear including control apparatus as described above.

Finally the invention relates to a method of controlling electrical switchgear, the method being implemented by means of control apparatus as described above, and the method comprising the following successive steps:

opening the moving contact under the effect of the opening mechanical spring moving the moving abutment element that drives the output member by abutment, so as to cause the connection end for connection to the moving contact to move from the point P1 to the point P2;

re-cocking the opening mechanical spring under the effect of switching on said at least one motor that causes the moving abutment element to move, and while keeping the connection end for connection to the moving contact at the point P2; and closing the moving contact, also under the effect of switching on the at least one motor, so as to cause the connection end for connection to the moving contact to move from the point P2 to the point P1.

Other characteristics and advantages of the present invention appear from the following detailed description given with reference to the accompanying drawings, in which:

FIGS. 1*a* to 1*c* are diagrams of the principle of the invention, showing the control apparatus at various stages during a control cycle starting from an instant when the moving contact is in its closed position and continuing until it returns to the same position after taking up its open position;

Figure 2:
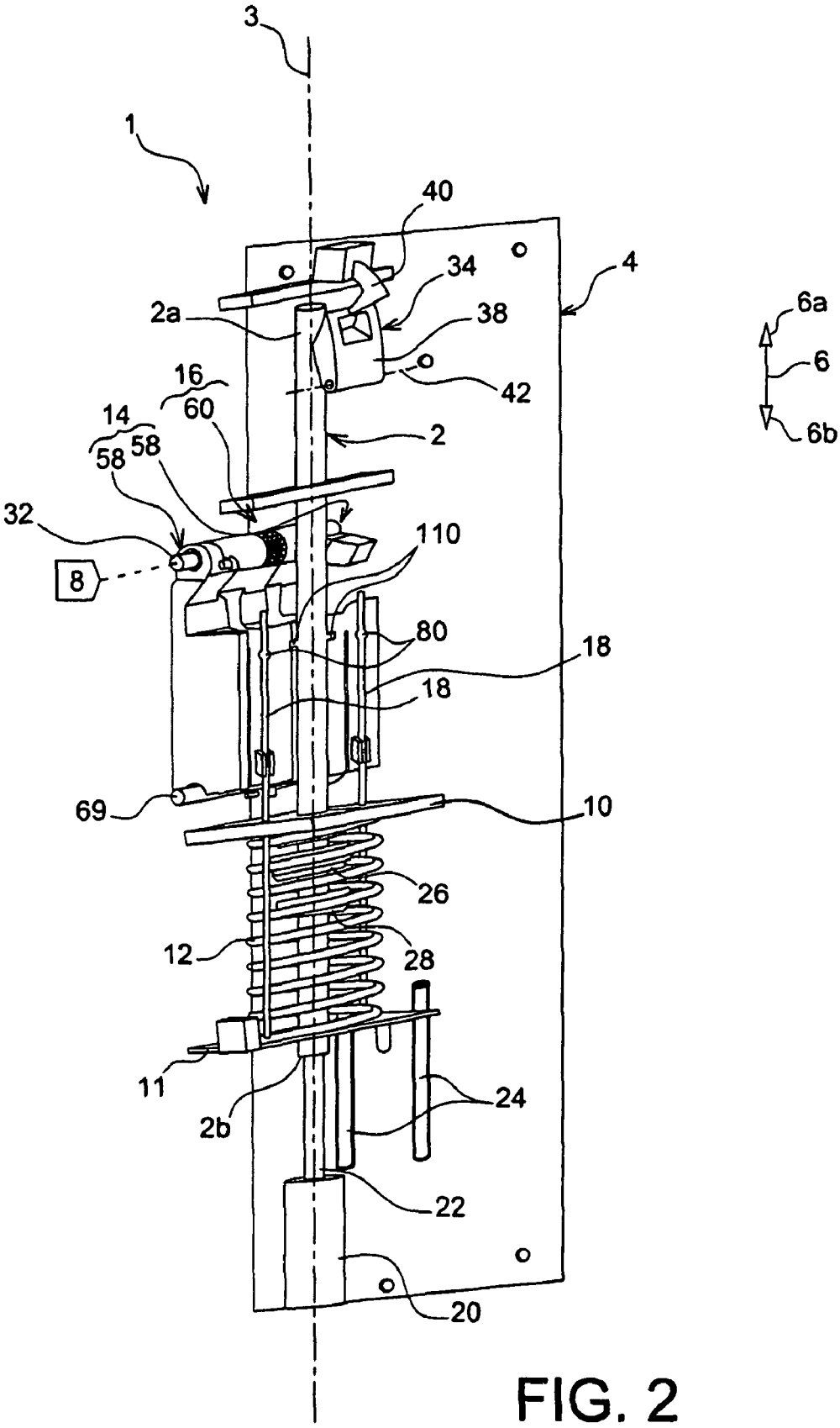
FIG. 2 is a perspective view of a preferred embodiment of control apparatus of the present invention, the apparatus being shown in a configuration that makes it possible to place the moving contact in the closed position.
Figure 3:
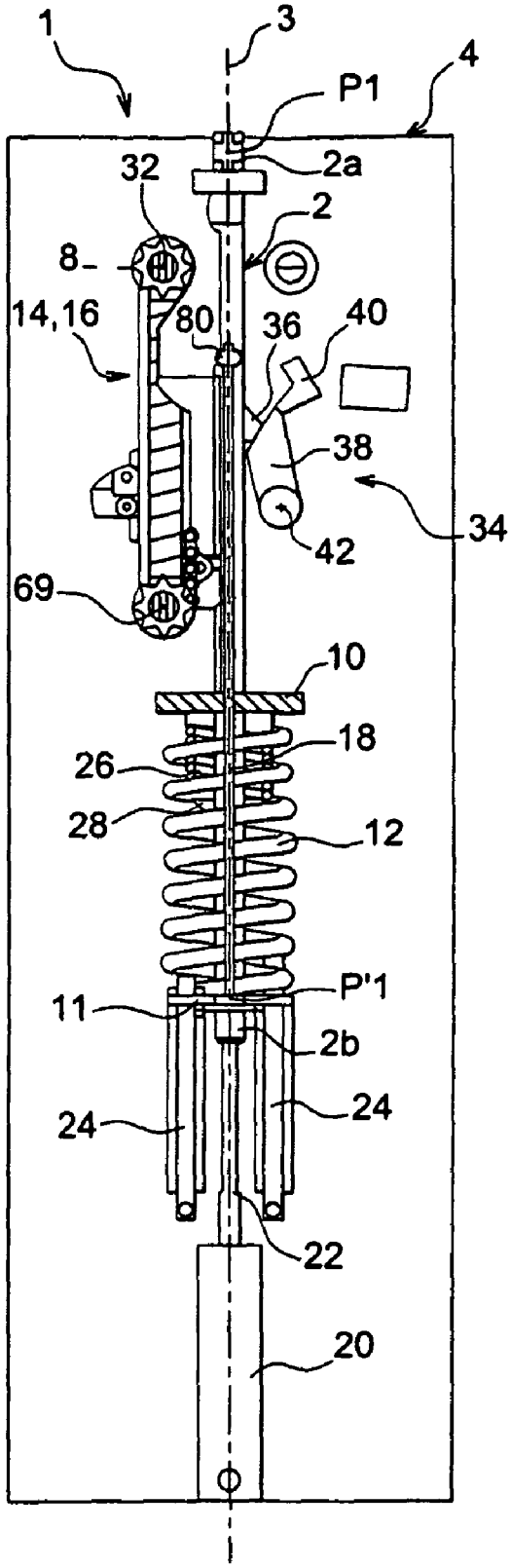
FIG. 3 is a side view partially in section of the control apparatus shown in FIG. 2.
Figure 4:
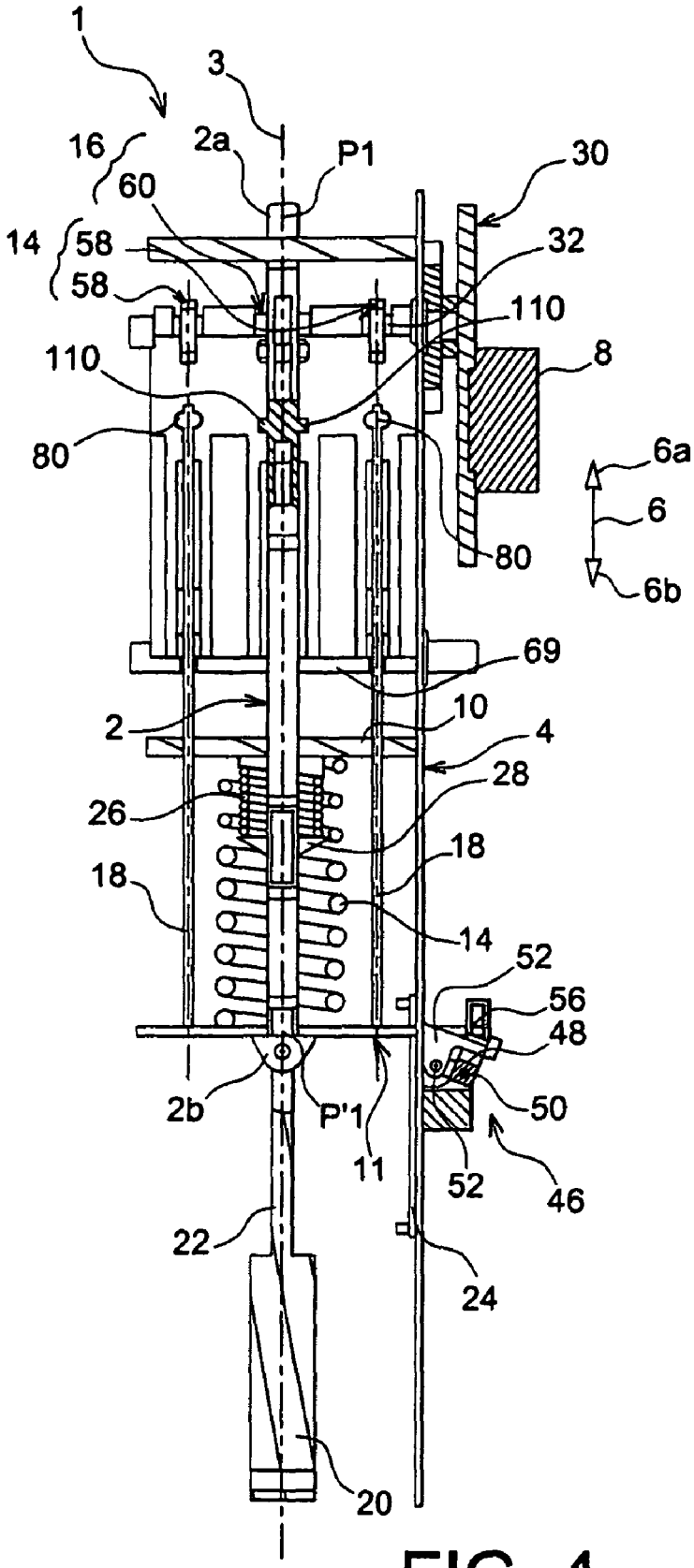
FIG. 4 is a front view partially in section of the control apparatus shown in FIGS. 2 and 3.
Figure 14:
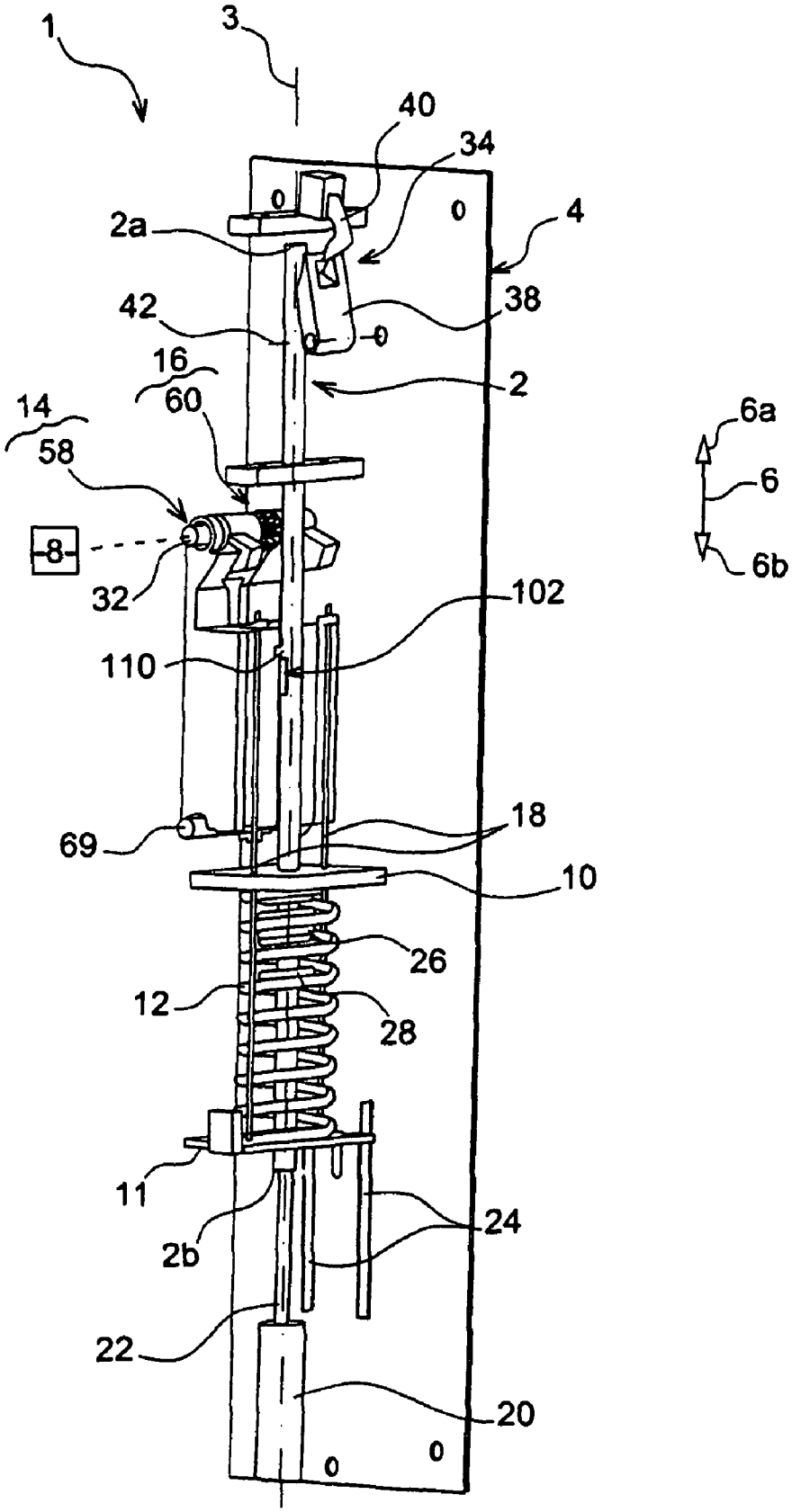
Figure 16A:
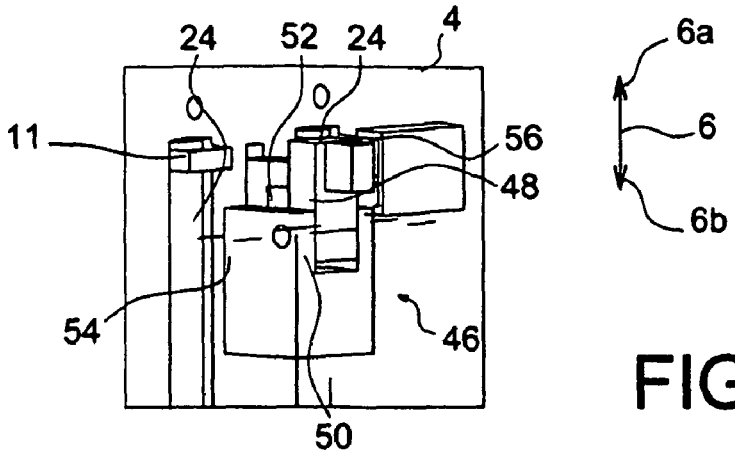
Figure 16B:
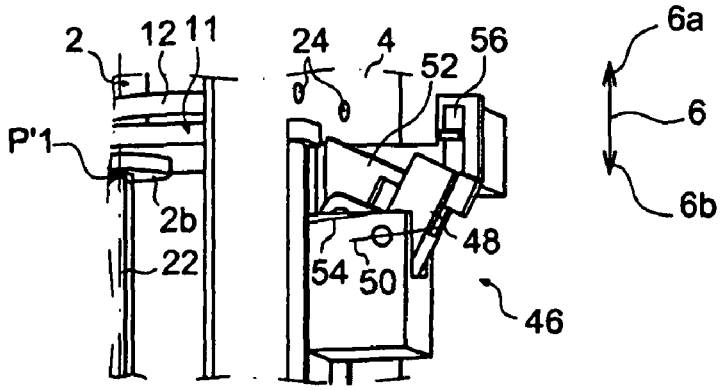
Figure 16C:
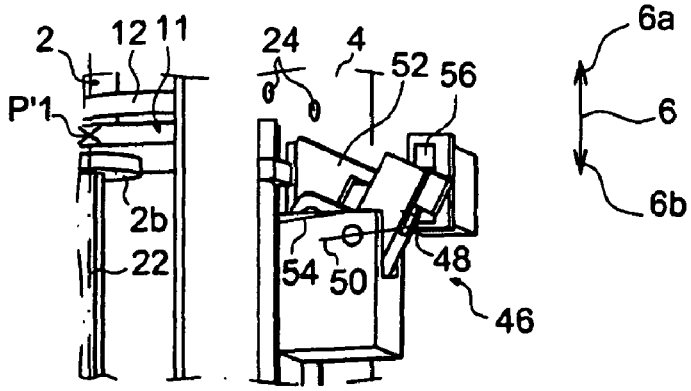
Figure 17:
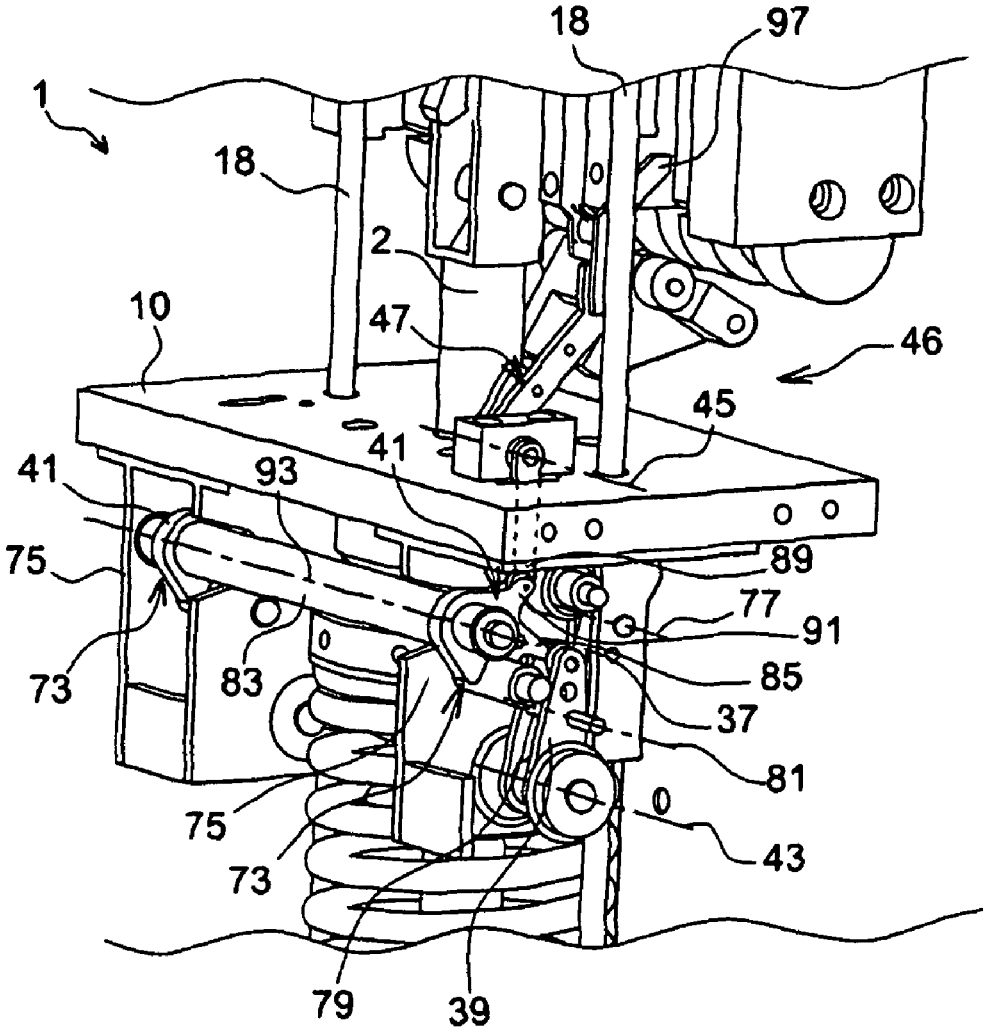
Figure 18:
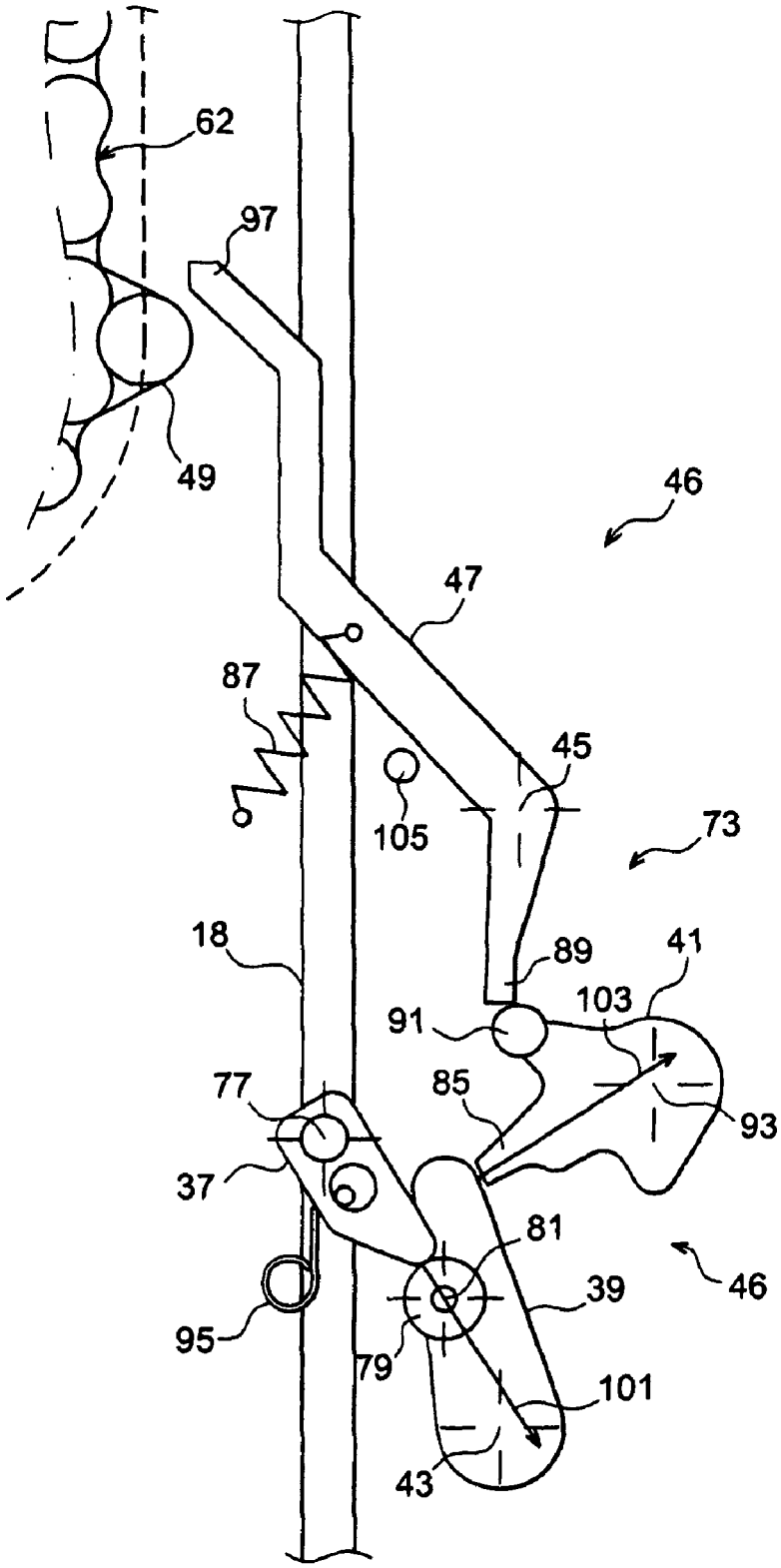

FIGS. 12*a* to 12*d* are diagrammatic views showing one of the two transmission assemblies of the first transmission means, in various configurations taken up successively at the end of the opening spring re-cocking stage;

FIGS. 13*a* to 13*d* are perspective views showing the system for holding the moving abutment element in the re-cocked position, in various configurations taken up successively at the end of the opening spring re-cocking stage;

FIG. 14 is a perspective view of the control apparatus shown in FIGS. 2 to 4, the apparatus being in a configuration taken up during a moving contact closure stage;

FIGS. 15*a* to 15*d* are diagrammatic views showing the transmission assembly of the second transmission means, in various configurations taken up successively at the end of the moving contact closure stage;

FIGS. 16*a* to 16*c* are perspective views showing the system for holding the moving abutment element in the re-cocked position, in various configurations taken up successively at the end of the moving contact closure stage;

FIG. 17 is a perspective view showing a system for holding the moving abutment element in the re-cocked position in an even more preferred embodiment of the present invention, the associated control apparatus being in a configuration as taken up at the end of the opening spring re-cocking stage; and FIG. 18 is a diagrammatic view of the system shown in FIG. 17 for holding the moving abutment element in the re-cocked position.

Figure 1A:
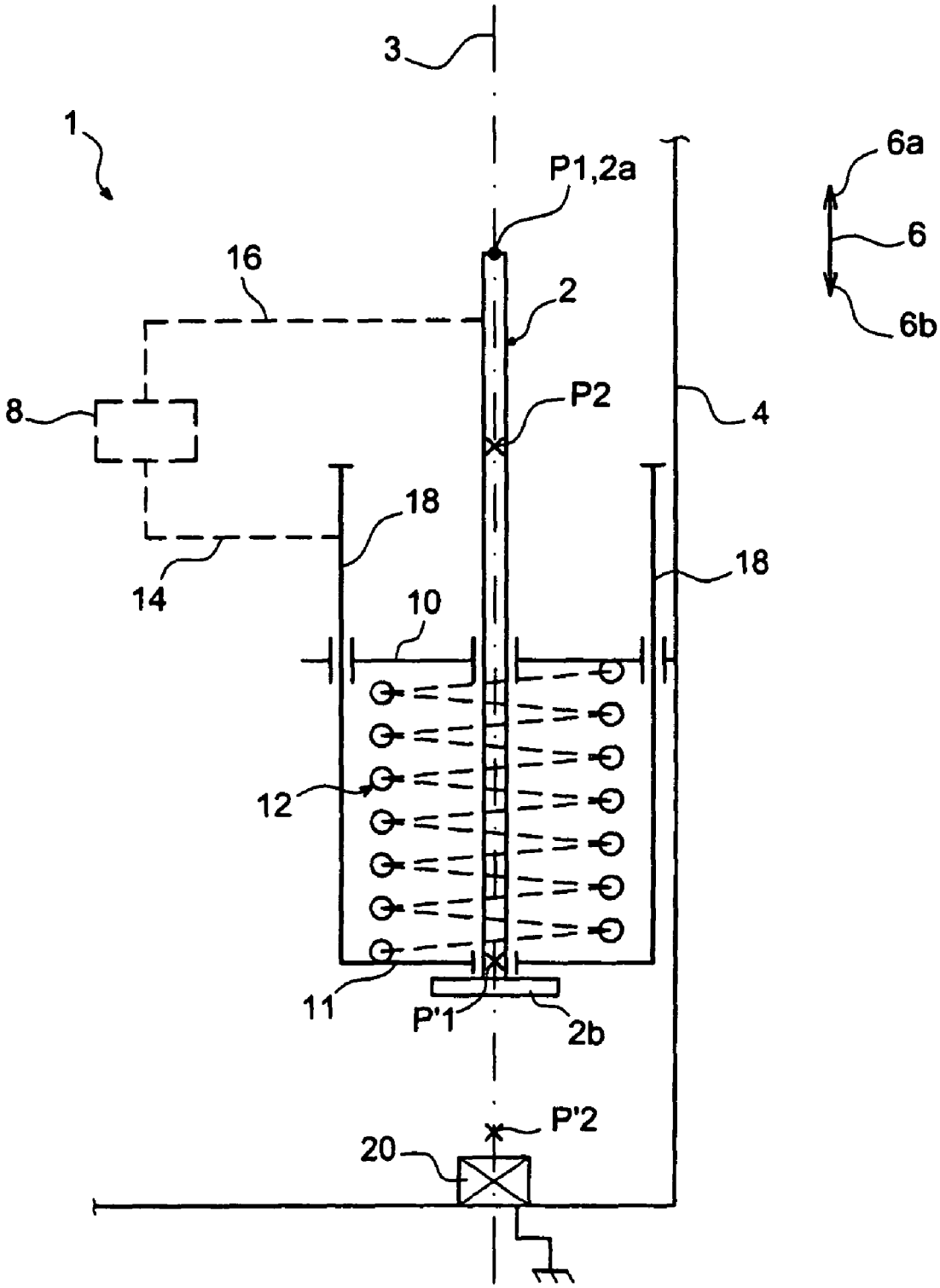
Figure 1B:
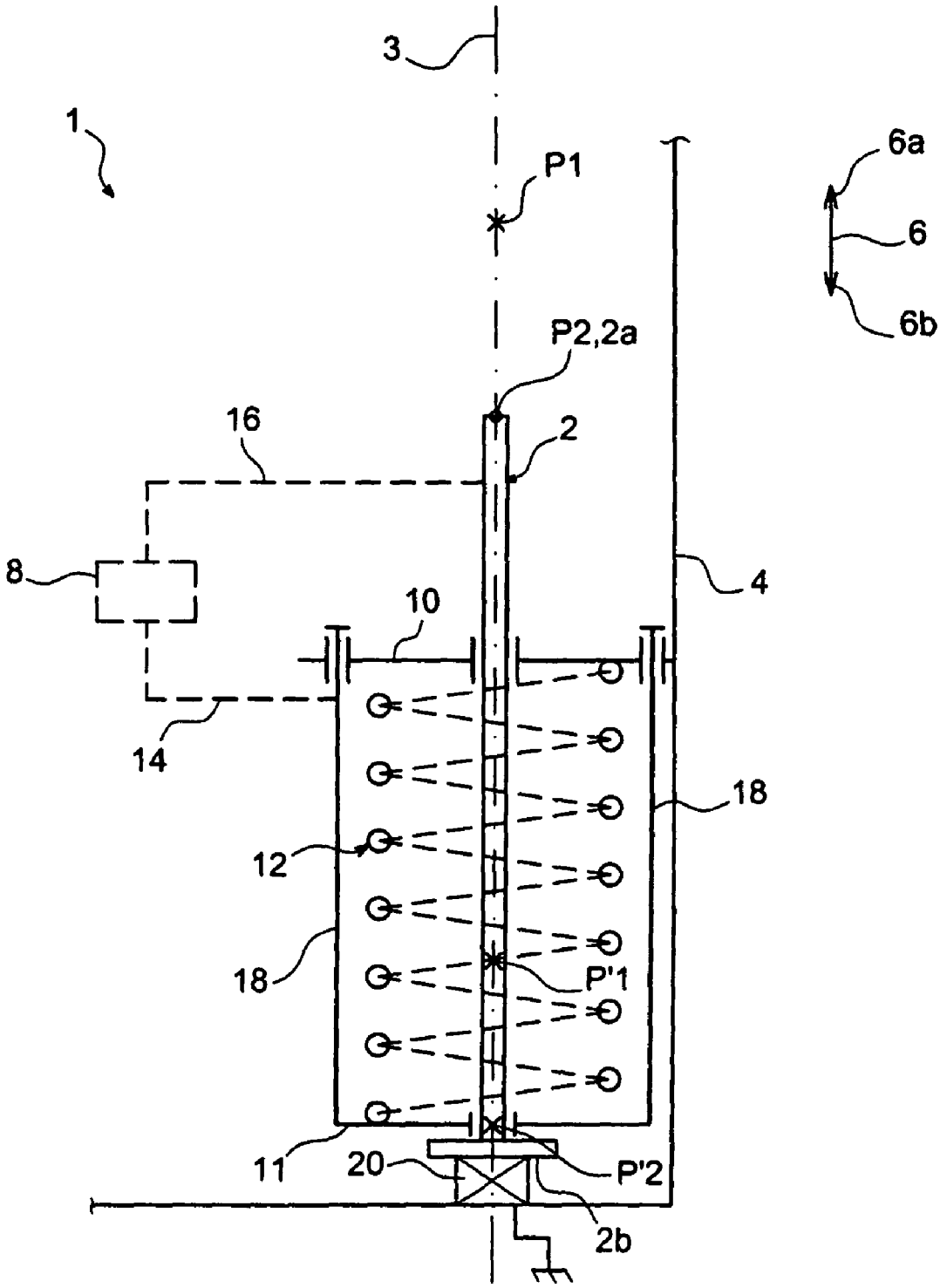
Figure 1C:
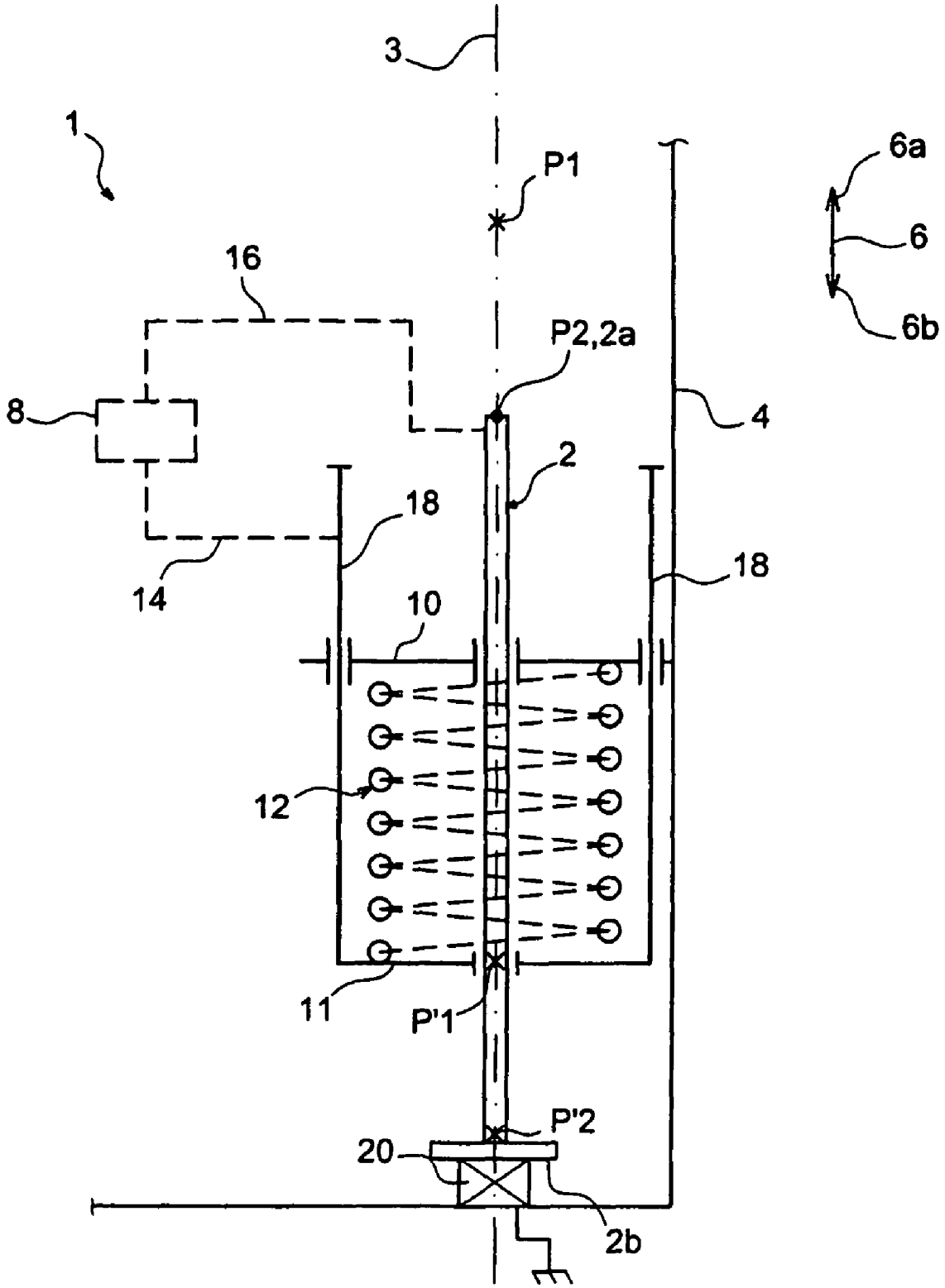

With reference firstly to FIGS. 1*a* to 1*c*, which diagrammatically show the principle of the invention, it is possible, highly diagrammatically, to see control apparatus 1 at various stages during a control cycle, starting from an instant when the moving contact (not shown) that it serves to control is in its closed position, and continuing until said moving contact returns to the same position after taking up its open position. FIG. 1*a* thus shows both the initial position and the final position of the cycle, the figures thus going cyclically in the order 1*a*, 1*b*, 1*c*, 1*a*, etc.

The control apparatus 1 is designed to equip electrical switchgear that includes a moving contact suitable for taking up a closed position and an open position, such as, for example, a circuit-breaker, a disconnector, or indeed grounding apparatus. It should be noted that the present invention also provides such switchgear.

In order to perform its function of controlling the moving contact, the apparatus 1 includes firstly an output member 2, e.g. in the form of a bar/connection rod designed to slide/move in translation along its own axis 3 relative to a stationary frame 4. Said member 2 has a connection "top" end 2*a* for connection to the moving contact and an abutment "bottom" end 2*b*. It can thus be observed that the end 2*a* can be connected either directly or indirectly to the moving contact of the switchgear, and is thus capable of being driven back-and-forth along the axis 3 of the member 2, thereby enabling it to deliver a linear output movement towards the moving contact, as indicated diagrammatically by the double-headed arrow 6, the direction 6*a* corresponding to the direction of closure of the moving contact, and the direction 6*b* corresponding to the direction of opening thereof. In other words, the double-headed arrow 6 corresponds to the axis along which the output member 2 moves in translation relative to the frame 4.

Secondly, the apparatus 1 includes a motor 8 of the servomotor type, and an opening mechanical spring 12 which can optionally be replaced with a plurality of springs, said spring 12 being received between a stationary element 10 fastened to the frame 4 and moving abutment element 11 that is offset from the stationary element 10 in the opening direction 6*b*.

As described in detail below, first transmission means 14 are interposed between the motor 8 and the moving abutment element 11, and second transmission means are interposed between the motor 8 and the output member 2. More precisely, the first transmission means 14 co-operate with two rods 18 parallel to the axis 6 and slidably passing through the stationary element 10, each of the two rods arranged on either side of the output member 2 having a bottom end fastened to the moving abutment element 11.

In the preferred example shown in FIGS. 1*a* to 1*c*, the spring 12 is a spring that operates in compression, with a top end pressed against the stationary element 10 of the apparatus 1, and a bottom end pressed against the moving abutment element 11.

With reference more specifically to FIG. 1*a*, it can be seen that the output member of the connection rod type 2 is in a closure position making it possible to place its end 2*a* in a position such that it guarantees that the moving contact is in its closed position. It is recalled that the output member is held firmly in this closure position by a holding system (not shown) which is described below by way of example, but which can be in any form known to the person skilled in the art.

In this closure position, the member 2 is naturally parallel to the axis 6 and its end 2*a* for connection to the moving contact is at a point P1 of the axis 3 along which it is mounted to move in translation relative to the frame 4. In addition, in this closure position, the mechanical spring 12 is compressed to the maximum extent between the elements 10 and 11, the moving element 11 being retained in the opening direction 6*b* by the bottom end 2*b* of the output member 2 finding itself in abutment against said moving element 11. For this purpose, provision is naturally made for the output member 2 to pass slidably through the moving abutment member 11 also parallel to the axis 6. By way of indication, in this closure position, the moving abutment element 11 is in a re-cocked position placing it at a point P'1 of the axis 3 along which it is also mounted to move in translation relative to the frame 4, and relative to the output member 2. It should be noted that said element 11 can be in the form of a plate that is substantially orthogonal to the above-mentioned axis 3.

Alternatively, it is possible to make provision for the moving element 11 to be retained in the opening direction 6*b* by a system (not shown) for holding it in the re-cocked position that is associated with said moving element, optionally in combination with the abutment procured by the bottom end 2*b* of the output member 2. In addition, one possible alternative that is described below makes provision that, when the output member is in its closure position, the moving element 11 is retained in the opening direction 6*b* solely by the abutment procured by the bottom end 2*b* of said member.

When an instruction to open the moving contact is received by the switchgear, the system for holding the output member in the closed position is deactivated, and the system for holding the moving abutment element in the re-cocked position is deactivated if such a system has been provided and has not yet been deactivated.

After this deactivation, an opening stage is initiated for opening the moving contact by means of energy being released from the mechanical spring 12. During this stage, the spring 12 drives the moving element 11 away from the stationary element 10 in the opening direction 6*b*, the moving element driving the output member 2 with it due to the abutment established between the element 11 and the bottom end 2*b* of said output member.

The opening stage ends when the moving contact reaches its open position, in which it is preferably held merely by the specific design and shape of the control apparatus, and thus without using a specific holding system although such a system can be provided without going beyond the ambit of the invention.

More precisely, it is possible to make provision for the stroke of the parts 11 and 2 along the axis 3, as generated by the spring 12, to be stopped by a shock absorber device 20, or indeed by a shock absorber auxiliary mechanical spring for absorbing the shock of the end of the opening stroke of the output member. When an auxiliary spring is used for shock-absorbing, the output member 2 can be held in the open position by means of a specific holding system (not shown), thereby making it possible to keep the auxiliary spring in its stressed state. The energy accumulated by the auxiliary spring at the end of the opening stage can then be released subsequently in order to facilitate initiation of the subsequent closure stage, which is essentially performed by means of the motor 8, as described below.

The output member 2 is then in an open position as shown in FIG. 1*b* in which the connection end 2*a* is positioned at a point P2 along the axis 3, and in which the moving abutment element 11 is in a "relaxed" position placing it at a point P'2 along the axis 3.

Preferably, for reasons of operating reliability, and in particular of availability of the electrical switchgear, this opening stage is performed solely under drive from the mechanical spring 12, and optionally under drive from other springs such as an auxiliary mechanical spring (not shown) for absorbing the shock of the end of the closure stroke of the output member, but preferably without the motor 8 acting. Electrical switchgear used for protecting structures for transporting and distributing electrical power must be capable of operating even in the event of failure of the auxiliary power sources.

Then, directly after the end of the opening stage of the moving contact, a re-cocking stage is initiated for re-cocking the spring 12 that has released its energy, at least in part. This re-cocking stage is performed by means of the motor 8 which, via the first transmission means 14, move the moving element 11 in the closure direction 6*a*, relative to the output member 2 which remains stationary relative to the stationary frame 4.

Thus, the output member 2 remains in a position guaranteeing that the moving contact remains in its open position, as shown in FIG. 1*c*. In other words, during this re-cocking stage, the moving abutment element moves in the direction 6*a* between the points P'2 and P'1 of the axis 3 while loading the spring 12, whereas the connection end 2*a* for connection to the moving contact remains positioned at point P2.

During this re-cocking stage of the spring 12, the rods 18 are driven in translation in the closure direction 6*a* relative to the stationary element 10 through which they pass, by the transmission means 14, thereby pushing the moving element 11 closer to the stationary element 10 and thus causing the opening mechanical spring 12 to accumulate energy by being compressed.

At the end of this re-cocking stage, the system for holding the moving abutment element (not shown) in the re-cocked position is activated, thereby making it possible to hold said element 11 in the re-cocked position shown in FIG. 1*c*, in spite of the pressure exerted thereon by the compressed spring 12.

When an instruction to close the moving contact is received by the switchgear, the system for holding the output member in the open position, if such a system is indeed provided, is deactivated, and a closure stage for closing the moving contact is initiated by the apparatus 1, by switching on the motor 8. Via the second transmission means 16, the motor 8 moves the output member 2 in the closure direction 6*a*, relative to the moving element 11 that remains stationary relative to the stationary frame, and relative to said stationary frame 4.

In other words, during this closure stage, the connection end 2*a* for connection to the moving contact moves in the direction 6*a* between the points P2 and P1 of the axis 3, while the moving abutment element 11 preferably remains positioned at the point P'1.

Preferably, this stage is performed solely with the energy transmitted by the motor 8, and without any energy from the spring 12. In addition, provision is preferably made so that, during this moving contact closure stage, the mechanical spring 12 does not accumulate any additional energy because the prior stage for re-cocking said spring has made it possible to accumulate sufficient energy to make it possible to perform a subsequent moving contact opening stage. However, as described below, provision can be made for a small amount of stressing of the opening spring 12 to take place at the end of the moving contact closure stage, in order to allow the moving abutment element 11 to be moved to a small extent, thereby making it possible to release it from the system for holding it in the re-cocked position. In addition, it is possible for provision to be made for the apparatus to be designed so that the spring 12 performs a braking function at the end of the moving contact closure stage, by compressing the spring, thereby making it possible to slow down the speed of movement of the connection end 2*a*, and the speed of movement of the entire output member 2 as it reaches the vicinity of its closure position shown in FIG. 1*a*.

However, as indicated above, during the moving contact closure stage during which the member 2 goes from its open position shown in FIG. 1*c* to its closure position shown in FIG. 1*a*, the moving abutment element 11 compressing the spring 12 can remain stationary, guaranteeing spacing that remains unchanged between the stationary element 10 and said moving element 11.

At the end of the closure stage, the system (not shown) for holding the output member in the closure position is activated, thereby making it possible to hold said member 2 in the position shown in FIG. 1*a*, in spite of the pressure exerted thereon by the compressed spring 12, via the abutment between the moving element 11 and the bottom end 2*b*.

With reference jointly to FIGS. 2 and 4, it is possible to see a preferred embodiment of the control apparatus 1 of the present invention, in a configuration making it possible to place the moving contact in the closed position.

In these figures, elements bearing the same reference numerals as those shown in FIGS. 1*a* to 1*c* correspond to elements that are identical or similar.

Thus, in FIGS. 2 to 4, it is possible to see that, in the preferred embodiment of the apparatus 1, the shock absorber 20 comprises a rod 22 slidably received in a shock absorber body, the bottom end of the member 2 being organized to come into contact with the rod 22. The rod 22 is arranged to extend along the axis of movement in translation 6. In addition, the output member 2 having the connection end 2*a* at the point P1 is in the form of a connection rod guided along the same axis 6 since it is mounted to slide in the stationary element 10.

Also for the purpose of ensuring that the apparatus operates properly and that the elements slide easily relative to one another, two guide rods 24 are provided for guiding the plate 11 forming the moving abutment member, as can be seen more clearly in FIG. 2. Said rods 24, arranged along the axis of movement in translation 6, are secured to the frame 4 and thus slidably pass through the moving member 11.

In addition, the control apparatus 1 is provided with an auxiliary mechanical spring 26 for absorbing the shock of the end of the closure stroke of the output member 2. Said auxiliary spring 26 is situated around the member 2, in the space defined internally by the opening spring 12 that is larger in size. Its high end bears against the stationary element 10, while, in the configuration in which the moving contact is in the closed position, its low end bears against an abutment 28 provided on the member 2 with a view to acting as a shock absorber therefor. This abutment 28 for absorbing the shock of the end of the stroke is designed to come into contact with the low end of the auxiliary spring 26 at the end of the closure stage, thereby compressing said spring and thus causing said spring to accumulate energy that is stored so long as another opening instruction is not received.

It should thus be understood that, in this configuration, the output member 2 as held in the closure position is urged by the opening spring 12 and by the auxiliary spring 26, even though said auxiliary spring exerts only a small or negligible amount of drive compared with the drive developed by the spring 12.

With reference more specifically to FIG. 4, it can be seen that the motor 8 is coupled to a motor and gearbox unit 30 connected it to a drive shaft 32. In addition, the motor 8 is coupled in a manner known to the person skilled in the art to a bank of suitably charged capacitors.

In order to hold the output member 2 in the closure position, the apparatus includes a holding system 34 that co-operates with a locking abutment 36 provided on a top portion of said member. In the activated configuration, the system 34 has a ratchet 38 held bearing against the abutment 36, thereby preventing movement in the opening direction 6*b* of the member 2 relative to the frame 4, to which the ratchet 38 is hinged freely about an axis 42. In order to lock the ratchet 38 in the position shown in FIGS. 2 and 3, a locking piece 40 is provided that is suitable for retracting and thus for releasing the ratchet 38, e.g. by means of a coil on applying an electrical instruction. For this purpose, and as can be seen more clearly in FIG. 3, it is indicated that the bearing face of the locking abutment 36 has an angle relative to the axis 3 of the output member 2, thereby making possible, on retraction of the locking piece 40, to generate a force, via the spring 12, that tends to push the ratchet 38 in a direction making it possible for said ratchet to be released from said locking abutment 36.

FIG. 4 also shows a system 46 for holding the moving abutment element 11 in the re-cocked position, said system thus being designed to co-operate with the element 11, and said system 46 being in a deactivated state when the moving contact is in its closed position, as explained below.

Figure 5:
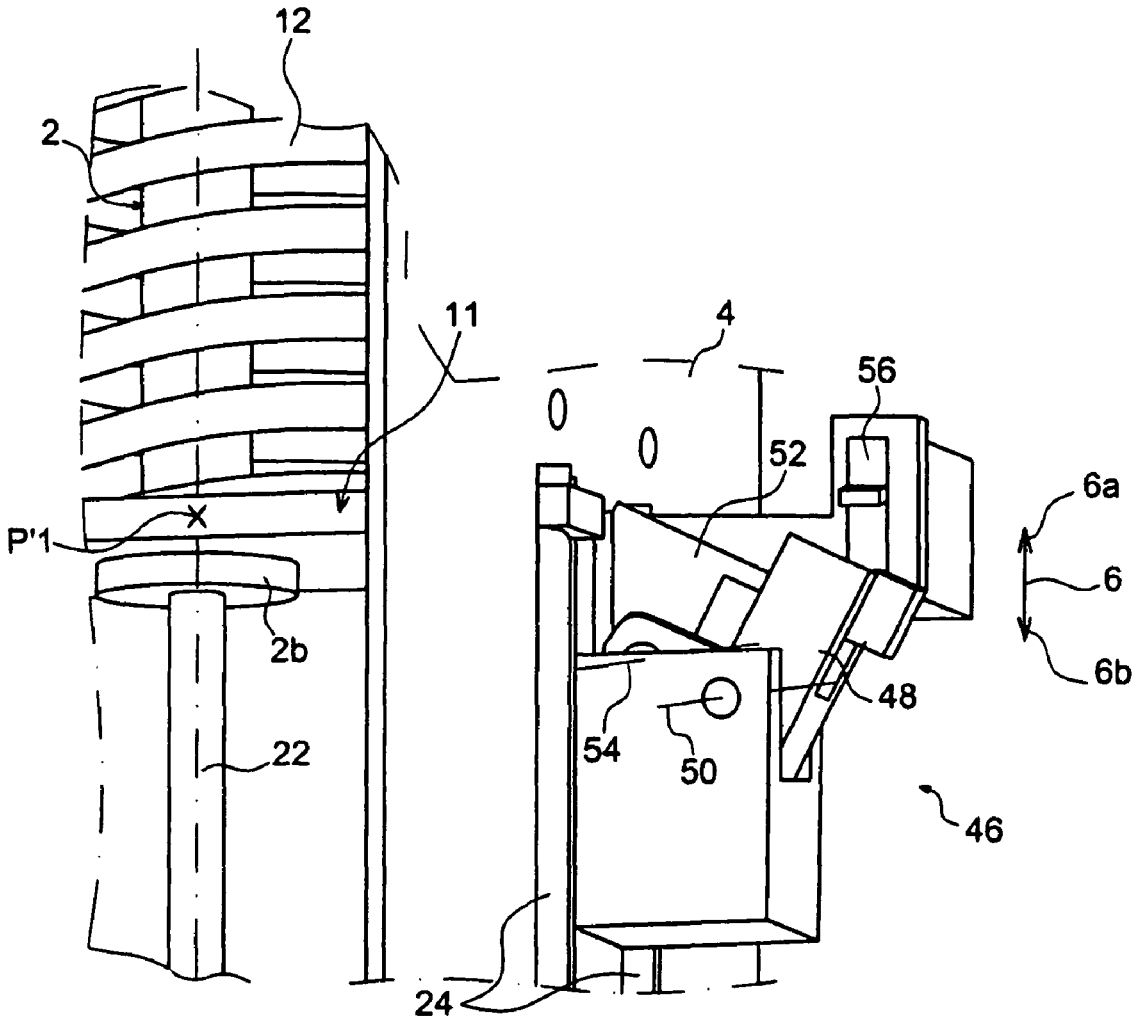
FIG. 5 is a perspective view of a system for holding the moving abutment element in the re-cocked position, the system being part of the control apparatus shown in FIGS. 2 to 4.

More precisely with reference to FIG. 5 which is a more detailed view of the system 46 for holding the moving abutment element in position, it can be seen that said system includes a support ratchet 48 hinged about an axis 50 to the frame 4 and held in the retracted position by return means of the spring type (not shown). In addition, on the support ratchet 48, a locking ratchet 52 is provided that is capable of co-operating with the moving member 11 or with an extension thereof, said locking ratchet 52 being hinged to the frame 4 about an axis 54 and held in the locking extracted position by return means of the spring type (not shown). In addition, the system 46 also includes a tilt ratchet 56 mounted in hinged manner on the moving member 11 and designed to come into contact with the support ratchet 48 during the re-cocking stage, in order to cause the ratchet 48 to tilt from its retracted position to an extracted position making it possible to cause the locking ratchet 52 to co-operate with the moving element 11, as described below.

In this configuration, although the locking ratchet 52 is held in the locking extracted position by the support ratchet 48, it is not capable of constituting an abutment for the moving element 11 since the support ratchet 48 is in the retracted position, bringing the locking ratchet 52 away from said element 11, as shown in FIGS. 4 and 5.

Thus, when the output member 2 is in its closure position, placing the moving contact in its closed position, the moving abutment element 11 is indeed held in its re-cocked position in which it is situated at the point P'1 of the axis 3, but thus preferably without assistance from the system 46 for holding it in position, which system is then inoperative.

With reference once again to FIGS. 2 to 4, a preferred embodiment of the first and second transmission means 14, 16 can be seen, each of which comprises one or two transmission assemblies that are substantially identical. Thus, the first transmission means 14 comprise two transmission assemblies 58 disposed on either side of the output member 2 as seen from the front, and the second transmission means 16 preferably comprise a single transmission assembly 60 disposed facing the output member 2 as seen from the side.

In addition, all three transmission assemblies 58, 60 are driven by the same drive shaft 32, and are also disposed in manner such as to be superposed along said shaft, as can be seen clearly in FIGS. 2 to 4.

Figure 6:
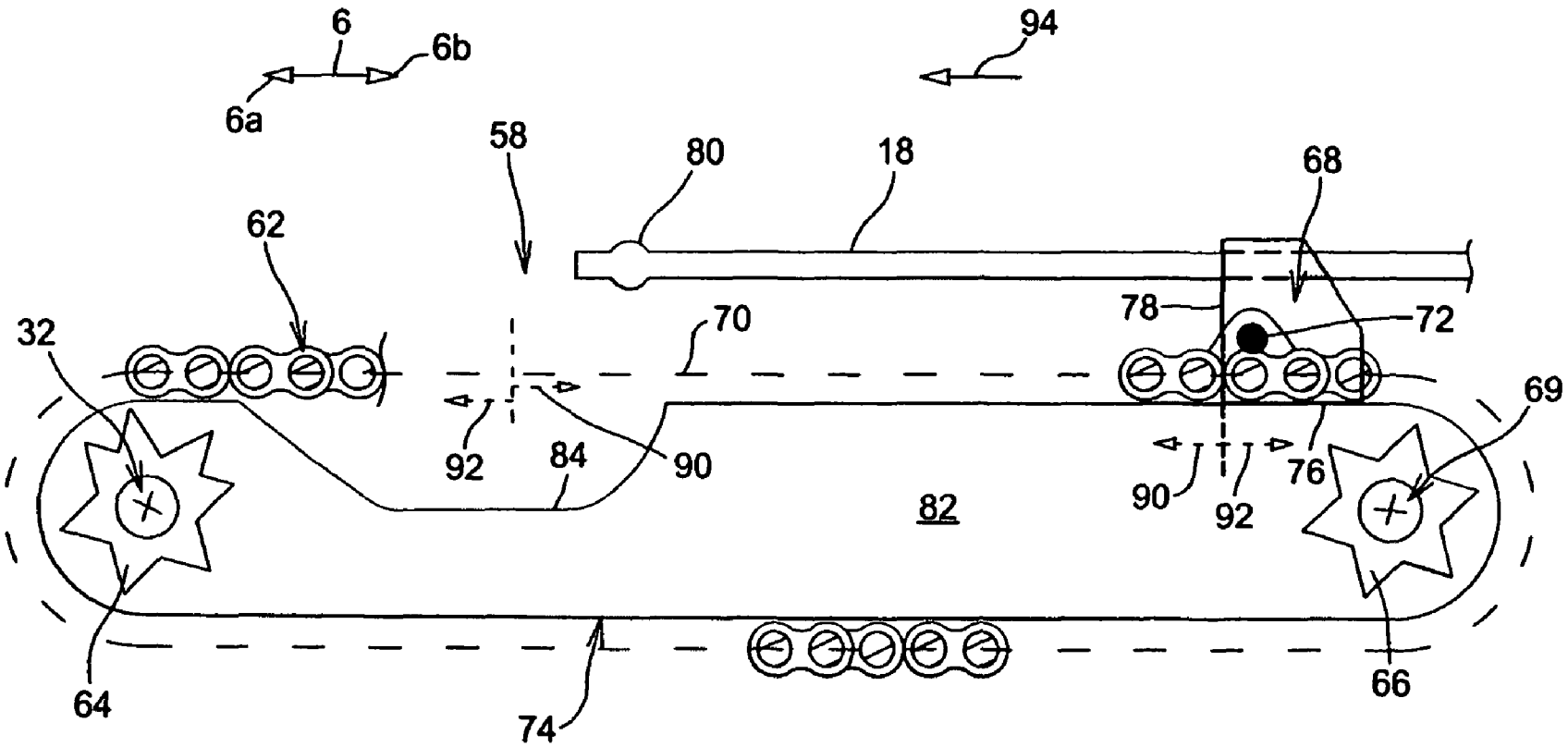
FIG. 6 is a diagrammatic view showing one of the two transmission assembles of the first transmission means that serve to drive the moving abutment element during the re-cocking stage, in a configuration taken up when the output member is its closed position, and when the moving abutment element associated with the opening spring is in its re-cocked position.

With reference to FIG. 6, it is possible to see one of the two transmission assemblies 58 of the first transmission means 14 that serve to drive the moving abutment element 11 during the re-cocking stage, this assembly 58 finding itself in a configuration taken up when the output member 2 is in its closure position and when the moving abutment element 11 is in its re-cocked position, as shown in FIGS. 2 to 4.

Overall, the assembly 58 comprises a chain 62, shown in part only, tensioned between two sprocket wheels 64, 66, one of which is driven by the shaft 32, and the other which is mounted on a free shaft 69 also co-operating with the other assemblies 58, 60. Naturally, the shaft 69 could also be driven by the motor 8, without going beyond the ambit of the invention.

On said chain or belt 62, a drive abutment or cup 68 is provided that is designed to be moved along a closed line 70 shown as a dashed line, said line 70 preferably being defined by the path of the chain 62. For this purpose, the drive abutment 68 is mounted on the chain 62, preferably in a manner such as to be hinged freely about an axis 72 that is parallel to the axes of the pins for interconnecting the chain links.

Since the drive abutment 68 is freely hinged mounted on the chain 62, in order to hold said abutment 68 in the desired position, an abutment support track 74 is provided against which a bearing face 76 of said abutment 68 rests, as shown in FIG. 6. This makes it possible to position an abutment face 78 angularly in the desired manner, namely so that it is capable of coming into contact with the associated follower abutment 80 provided at the free end of the rod 18 with which said transmission assembly 58 co-operates.

The abutment support track 74 is defined by a body 82 that is stationary relative to the frame, and it substantially follows the closed line 70 while being capable of being offset outwards or inwards therefrom as shown in FIG. 6, except at an appropriately located portion where the track 74 presents a setback 84 into which the drive abutment 68 is designed to retract automatically by pivoting, as described below.

The closed line 70 has an "active" portion along which the drive abutment is designed to drive its associated follower abutment 80 that is secured to the moving abutment element 11, for the purpose of bringing said mobile abutment element from the relaxed position to the re-cocked position as described below, and a "passive" portion along which the drive abutment 68, since it does not act on its associated follower abutment 80, allows the moving abutment element 11 to go from the re-cocked position to the relaxed position.

In the configuration in which the output member 2 finds itself in the closure position, i.e. before another order to open the moving contact, the drive abutment 68 moves to the outlet of the passive portion that is indicated diagrammatically by the reference 92, namely in the immediate vicinity of the junction with the active portion diagrammatically indicated by the reference 90. In this position, and more generally all the way along the passive portion, it does not generate any obstacle to the moving abutment element 11 being moved from the re-cocked position to the relaxed position, insofar as it does not find itself in the path of the follower abutment 80.

As described below, the chain 62 being moved in the chain movement direction 94 causes said drive abutment 68 to penetrate into the active portion 90 of the closed line 70.

Naturally, the abutment 68 of said assembly 58 and the drive abutment of the other assembly of the first transmission means 14 are designed to be moved in phase with each other.

Figure 7:
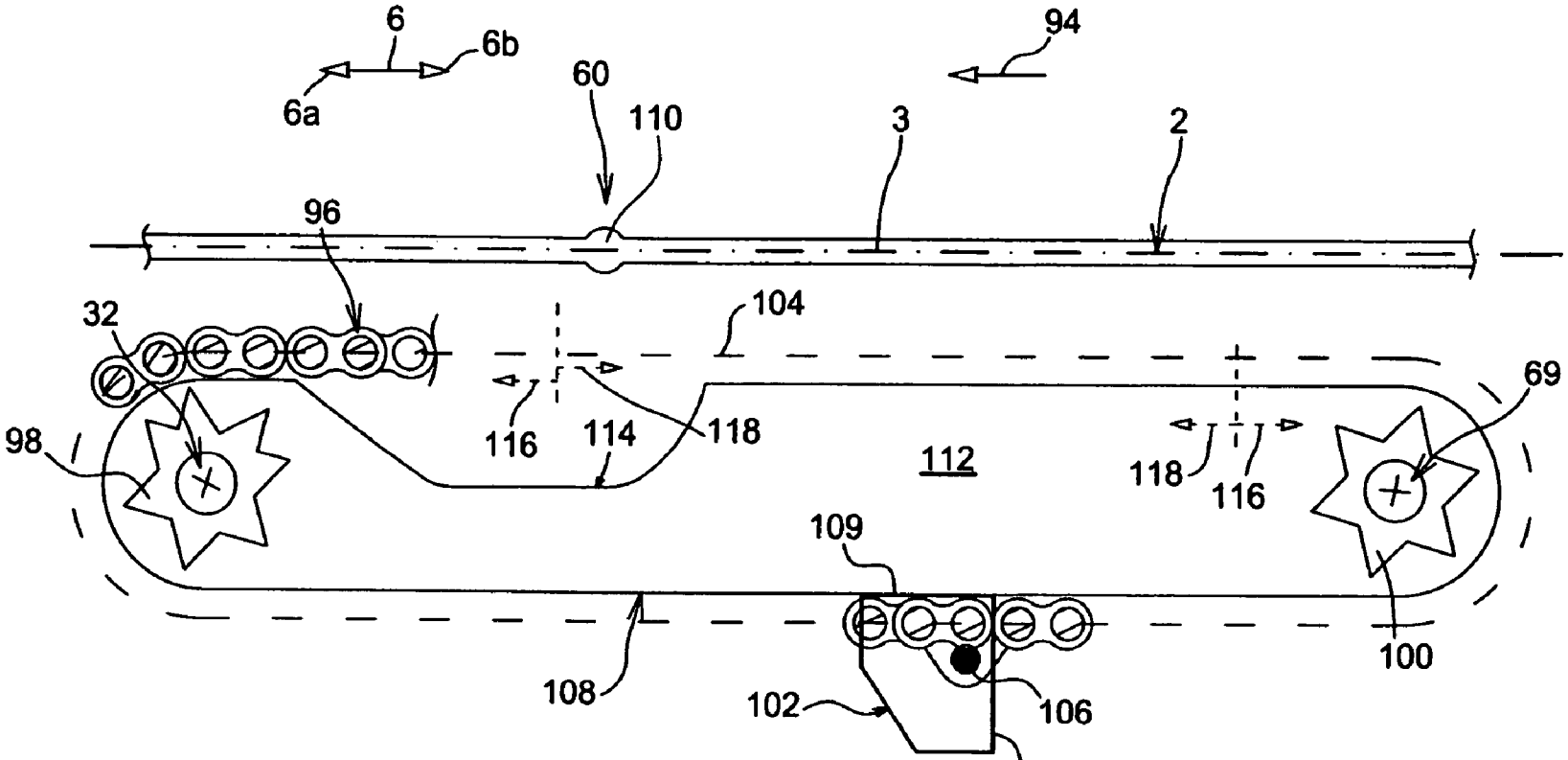
FIG. 7 is a diagrammatic view showing the transmission assembly of the second transmission means that serve to drive the output member during the closure stage, in a configuration taken up when said output member is in its closure position.

With reference to FIG. 7, it is possible to see the transmission assembly 60 of the second transmission means 16 that are designed to drive the output member 2 during the closure stage, said assembly 60 finding itself in a configuration taken up when the output member 2 is in its closure position, as shown in FIGS. 2 to 4.

Overall, the assembly 60 is identical or similar to the assembly 58, in that it comprises a chain 96 shown in part only, e.g. a double chain defining two parallel paths disposed on either side of the output member 2 as seen from the front, said chain being tensioned between two sprocket wheels 98, 100, one of which is driven by the shaft 32, and the other of which is mounted on the free shaft 69. On the chain or belt 96, a drive abutment or cup 102 is provided that is designed to be moved along a closed line 104 shown as a dashed line, said line 104 preferably being defined by the path of the chain 96. For this purpose, the drive abutment 102 is mounted on the double chain 96, preferably in a manner such that it is hinged freely about an axis 106 that is parallel to the axes of the pins for interconnecting the chain links Since the drive abutment 102 is freely hinge mounted on the chain 96, in order to hold said abutment 102 in the desired position, an abutment support track 108 is provided against which a bearing face 109 of said abutment 102 rests, as shown in FIG. 7. This makes it possible to position an abutment face 111 angularly in the desired manner, namely so that it is capable of coming into contact with the associated follower abutment 110 secured to the output member 2.

The abutment support track 108 is defined by a body 112 that is stationary relative to the frame, and it substantially follows the closed line 104 while being capable of being offset outwards or inwards therefrom as shown in FIG. 7, except at an appropriately located portion where the track 108 presents a setback 114 into which the drive abutment 102 is designed to retract automatically by pivoting, as described below.

It is indicated that the closed line 104 has an "active" portion along which the drive abutment 102 is designed to drive its associated follower abutment 110 that is secured to the member 2 for the purpose of bringing said member from the opening position to the closure portion as described below, and a "passive" portion along which the drive abutment 102, since it does not act on its associated follower abutment 110, allows the member 2 to go from its closure position to its opening position.

In the configuration in which the output member 2 finds itself in the closure position, i.e. before another order to open the moving contact, the drive abutment 102 finds itself in the passive portion that is indicated diagrammatically by the reference 116, namely remote from the active portion that is indicated diagrammatically by the reference 118. In this position, and more generally all the way along the passive portion, it does not generate any obstacle to the output member 2 being moved from the closure position to the opening position, insofar as it does not find itself in the path of the follower abutment 110.

In the same way as for the active portion 90 of the assembly 58, the active portion 116 is preferably constituted by a straight line segment that is parallel to the axis of movement in translation 6.

Naturally, the abutment 102 of said assembly 60 and the drive abutment of the other assembly of the second transmission means 16 are designed to be moved in phase with each other. Conversely, as shown in FIGS. 6 and 7, the drive abutments 68, 102 are moved due to the same shaft 32 being rotated while being synchronized continuously with a determined phase offset making it possible to perform successively the three distinct stages of opening the moving contact, of re-cocking the opening mechanical spring, and of closing the moving contact. By way of indication, it can be understood from the figures that the drive abutments 68 are ahead relative to the drive abutments 102, in the direction in which the chain 94 moves.

When an order to open the moving contact is received by the switchgear, the system 34 for holding the output member 2 in the closed position is deactivated, e.g. after an electrical instruction causing the locking piece 40 to retract. As indicated above, the bearing face of the locking abutment 36 then makes it possible, via the force generated by the springs 12 and 26 relaxing, to exert a force that tends to push the ratchet 38 in a direction enabling the ratchet to be released from the locking abutment 36.

Thus, a moving contact opening stage is initiated by energy being released from the mechanical spring 12, and from the auxiliary spring 26. During this stage, the spring 12 urges the moving element 11 which thus moves away from the stationary element 10 in the opening direction **6*b*, while driving with it the output member 2 due to the abutment established between the element 11 and the bottom end 2*b*** of the output member.

Figure 8:
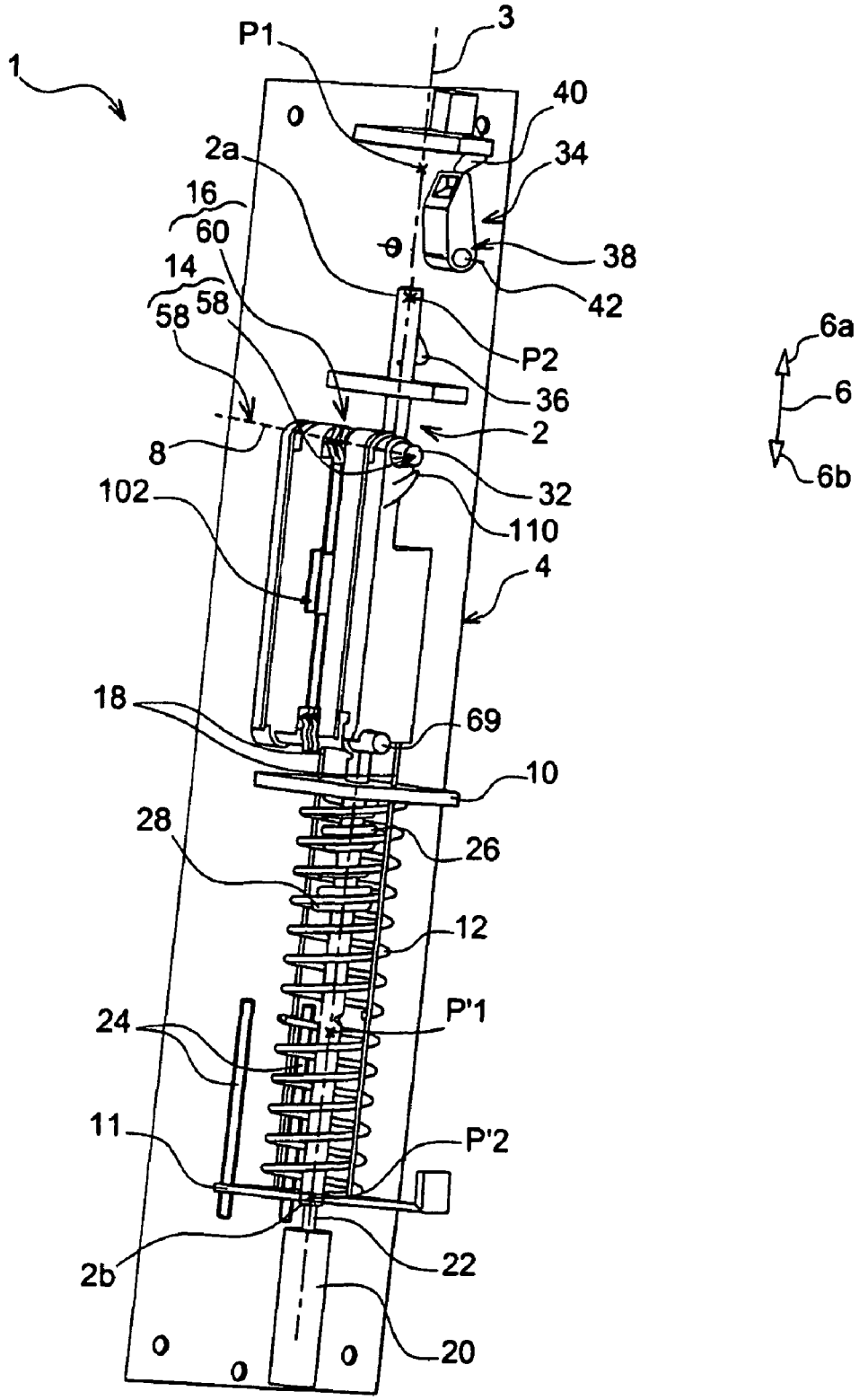
FIG. 8 is a perspective view of the control apparatus shown in FIGS. 2 to 4, the apparatus being in a configuration making it possible to place the moving contact in the open position.

The opening stage is complete once the moving contact has reached its open position, in which the bottom end **2*b* of the output member 2 rests in abutment against the shock absorber device 20, as shown in FIG. 8. The output member 2 is then in its opening position in which its connection end 2*a* is positioned at the point P2 of the axis 3, and in which the moving abutment element 11 is in the relaxed position that places it at the point P'2 of the axis 3**.

Figure 9:
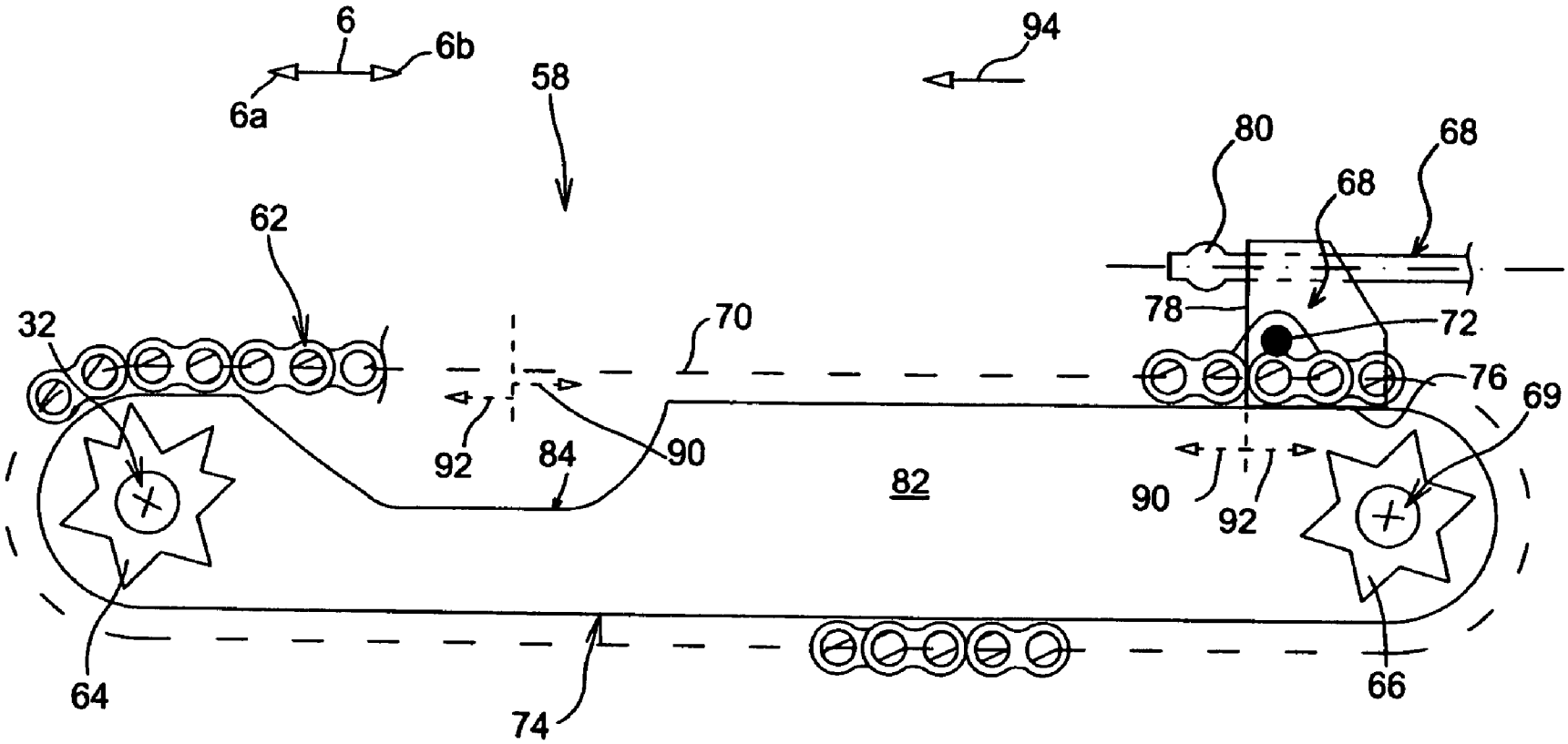
FIG. 9 is a diagrammatic view of one of the two transmission assemblies of the first transmission means, in a configuration taken up when the output member is in its open position, and when the moving abutment element is in its relaxed position.
Figure 10:
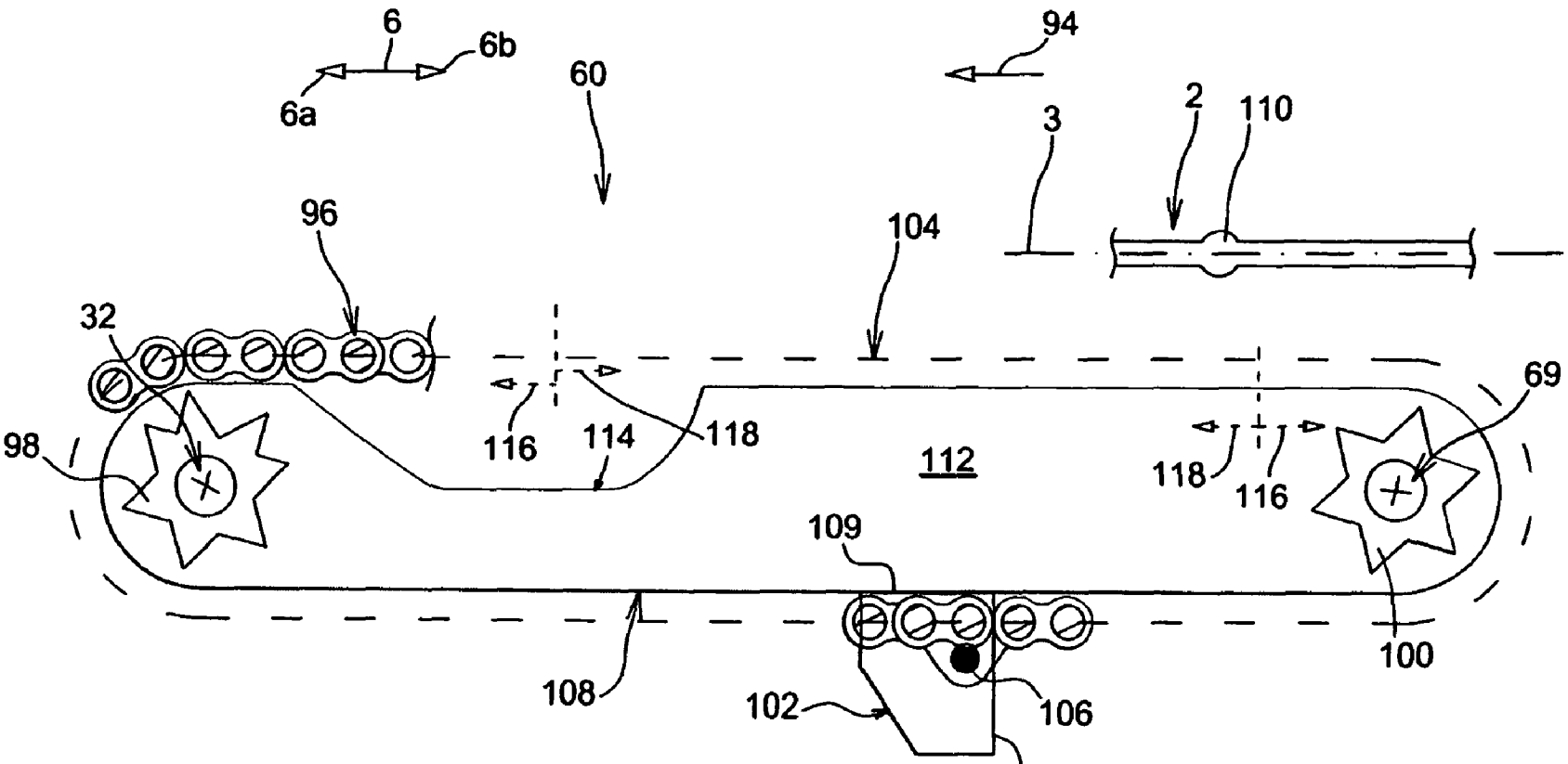
FIG. 10 is a diagrammatic view showing the transmission assembly of the second transmission means, in a configuration taken up when the output member is in its opening position.

Preferably, for reasons of operating reliability, in particular of availability of the electrical switchgear, said opening stage is performed solely under drive from the above-mentioned mechanical springs, i.e. without action from the motor 8. That is why, in FIGS. 9 and 10, it can be seen that the drive abutments 68, 102 have not been moved relative to the respective positions that they were in prior to initiation of the opening stage. In FIGS. 9 and 10 which are diagrams of the transmission means in a configuration taken up at the end of the opening stage, it can be seen that the follower abutment 80 provided on the high end of the rod 18 has naturally been moved in the opening direction 6*b* so as to come closer to the associated drive abutment 68, e.g. until it is in contact therewith or in the very close vicinity thereof. In addition, the follower abutment 110 provided on the output member 2 has also been moved in the opening direction 6*b*, over a stroke corresponding to the distance P1P2 or P'1P'2 along the axis 3.

Figure 11:
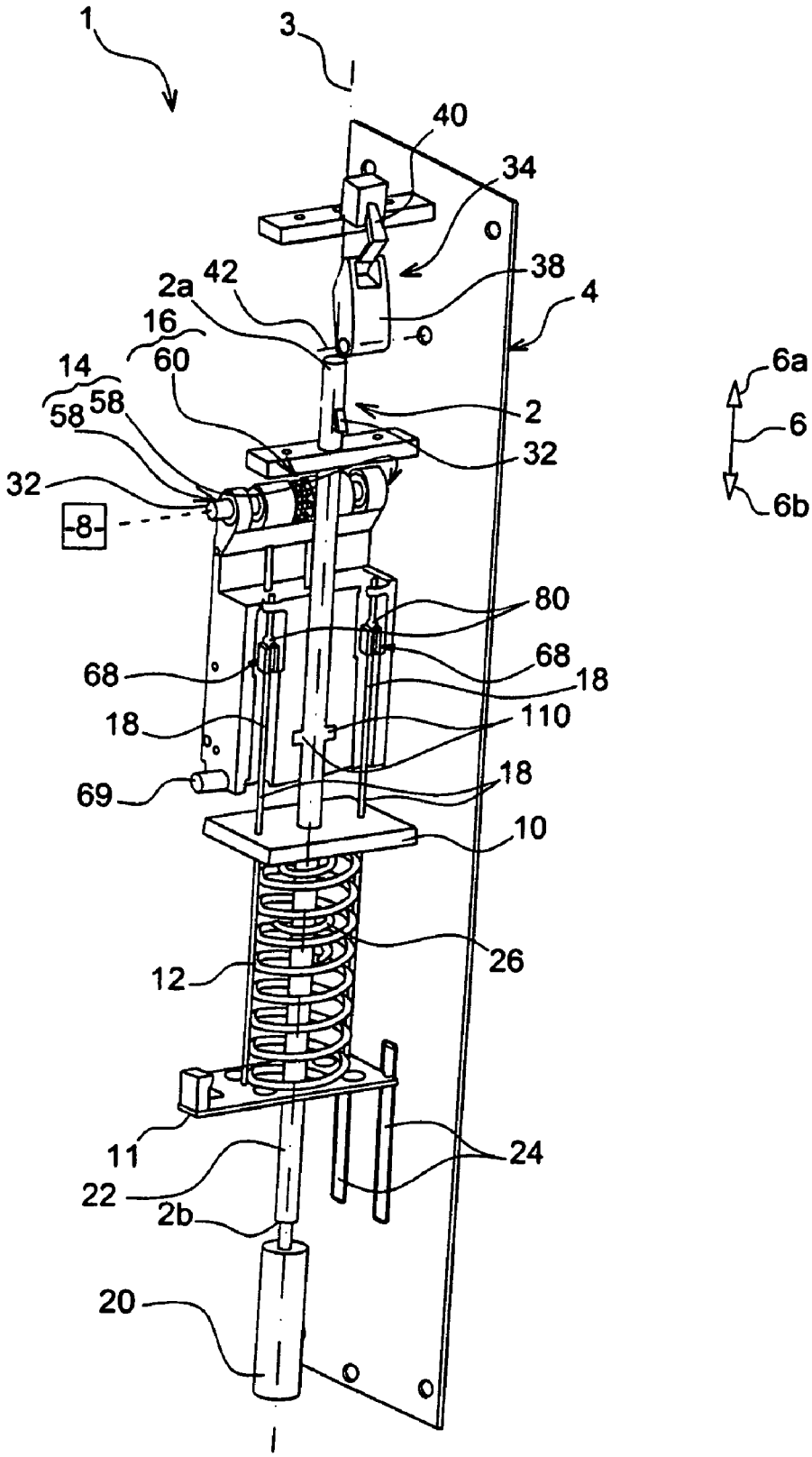
FIG. 11 is a perspective view of the control apparatus shown in FIGS. 2 to 4, the apparatus being in a configuration taken up during an opening spring re-cocking stage.

Directly after completion of the moving contact opening stage, a re-cocking stage is initiated for re-cocking the spring 12 that has released its energy. This re-cocking stage is performed by means of the motor 8 which, via the first transmission means 14, cause the moving element 11 to be moved in the closure direction 6*a* relative to the output member 2 which remains stationary relative to the stationary frame 4. The output member 2 remains in a position in which it guarantees that the moving contact remains in its open position, as shown in FIG. 11, in which it can be seen that the abutment low end 2*b* remains in contact with the shock absorber device 20.

During the re-cocking stage for re-cocking the spring 12, the rods 18 are driven in translation in the closure direction 6*a* relative to the stationary element 10 through which they pass, due to the shaft 32 moving the drive abutments 68 which drive with them their respective follower abutments 80 along the active portion of the closed line. As shown in FIG. 11, the drive abutments 68 being caused to move in this way pushes the moving element 11 towards the stationary element and thus causes the opening mechanical spring 12 to accumulate energy, by it being compressed. By way of indication, each drive abutment 68 can be in the form of two side plates between which the associated rod 18 can be inserted during the re-cocking stage, as can be seen in FIG. 11. In addition, it should be noted that, throughout the re-cocking stage for re-cocking the spring 12, the drive abutments 102 are naturally also moved along the passive portions 116 of their respective closed lines 10, without thus ever causing the output member 2 to move.

Figure 12A:
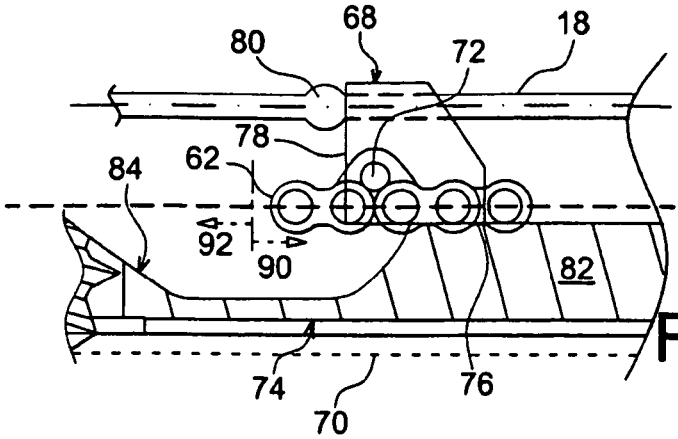
Figure 12B:
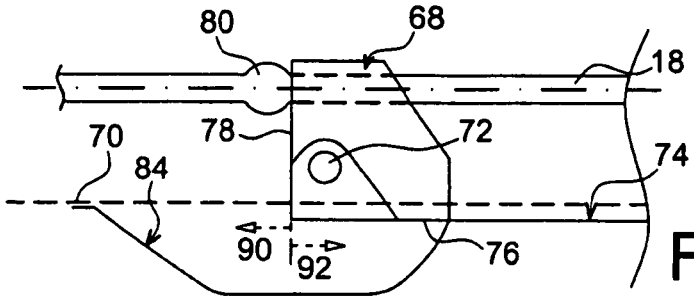
Figure 12C:
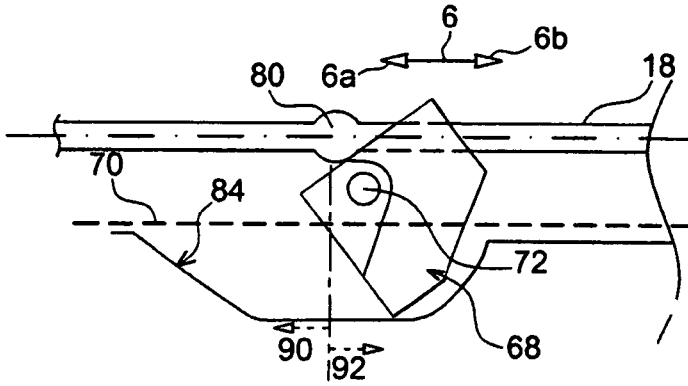

With reference to FIGS. 12*a* to 12*d*, a little before the end of the re-cocking stage, the drive abutment 68 having its abutment face 78 in contact with the follower abutment 80 places said follower abutment in a position enabling the mobile element 11 to take up its re-cocked position in which it is situated in the vicinity of the point P'1. However, the movement of the abutment 68 is not stopped at this stage shown in FIG. 12*a*, but rather it continues so as to cause the abutment 68 to retract into the setback 84, and thus so as to cause the follower abutment 80 to be released. The abutment 68 continues to move until it reaches the junction between the active portion 90 and the passive portion 92 of the closed line 70, as shown in FIG. 12*b*. Whereupon, the bearing face 76 of the abutment 68 is no longer in abutment against the support track 74, but rather it is in register with the setback 84. It is then the follower abutment 80 tending to move in the opening direction 6*b* under drive from the spring 12 that bears on the abutment 68 by moving, thereby causing the abutment to pivot about the axis 72, and thus causing said abutment 68 to retract into the setback 84 as shown in FIG. 12*c*. By way of indication, the appropriately offset pressing exerted by the follower abutment 80 for the purpose of driving the abutment 68 in rotation about its axis 72 thus results in said follower abutment 80 moving in the opening direction 6*b*, but can also in part result in the drive abutment 68 continuing to be moved along the passive portion 92 of the closed line 70.

Figure 12D:
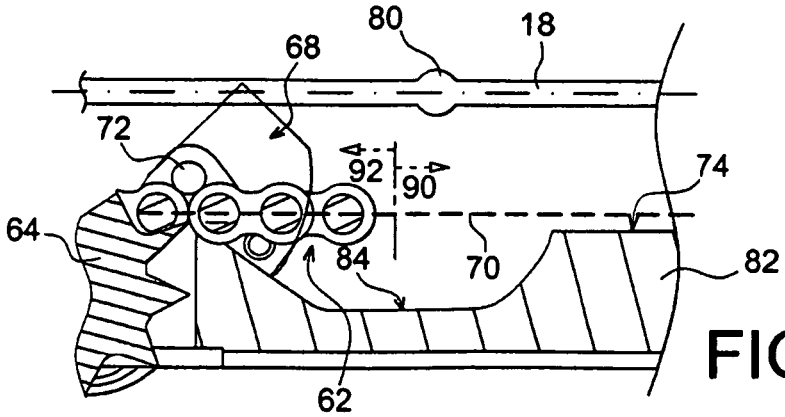

When, under drive from the spring 12, the follower abutment 80 resumes its position shown in FIG. 12*a*, enabling the moving element 11 to take up its re-cocked position in which it is situated in the vicinity of the point P'1, it is totally released from its associated drive abutment 68 which is refracted inside the setback 84, and held in this position by the system 46, as described below. By way of indication, it should be noted that the re-cocking stage can optionally be continued until the abutment 68 is moved significantly away from the associated follower abutment 80, as shown in FIG. 12*d*. In which case, the re-cocking stage is performed by moving the drive abutment 68 over its active portion 90, and over a small fraction of the passive portion 92. Although not shown, it is specified that, at this instant at the end of the re-cocking stage, the drive abutment 102 is preferably situated in contact with its associated follower abutment 110, or in the very close vicinity thereof. In other words, the drive abutment 102 is situated at the junction between the passive portion 116 and the active portion 118 of the closed line 104, ready to travel over said active portion 118 for the purpose of initiating moving the output member 2 towards its closing position.

As indicated above, at the end of this re-cocking stage, the system 46 for holding the moving abutment element in the re-cocked position is activated, thereby making it possible to hold said element 11 in the re-cocked position, in spite of the pressure exerted thereon by the spring 12.

Figure 13A:
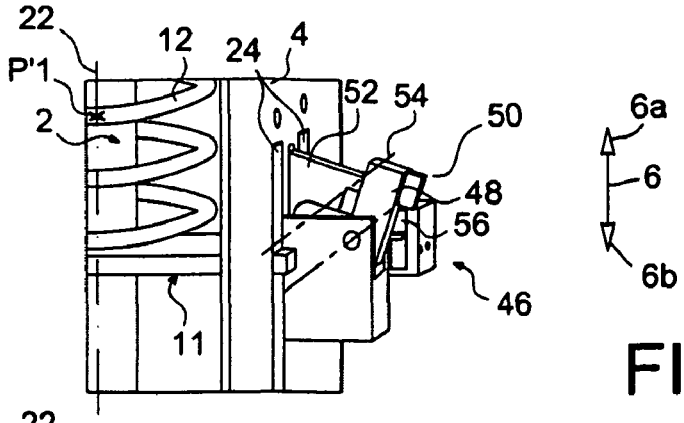

More precisely with reference to FIGS. 13*a* to 13*d*, it is possible to see that, during the re-cocking stage for re-cocking the opening spring 12, resulting in the moving element 11 being moved upwards, the first element of the system 46 that comes into operation is the tilt ratchet 56 which establishes the contact with the support ratchet 48, for the purpose of progressively tilting the ratchet 48 from its retracted position to its extracted position, as shown in FIG. 13*a*. The action exerted by the tilt ratchet 56 on the ratchet 48 in order to cause it to tilt about the axis 50 thus opposes the return means that continuously push the ratchet 48 towards its retracted position (shown in FIG. 5).

Figure 13B:
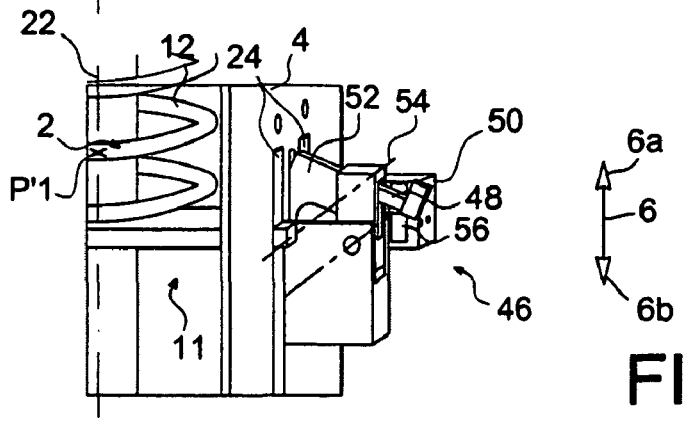

Then, when the moving element 11 has moved far enough in the closure direction 6*a*, it establishes the contact with the locking ratchet 52, for the purpose of causing it to tilt progressively from its locking extracted position to its retracted position, as shown in FIG. 13*b*. Here too, the action exerted by the moving element 11 on the ratchet 52 in order to cause it to tilt about the axis 54 thus opposes the return means continuously pushing the ratchet 52 towards its locking extracted position (shown in FIG. 5). At the same time, the tilt ratchet 56 continues to cause the ratchet 48 to tilt progressively from its refracted position to its extracted position.

Figure 13C:
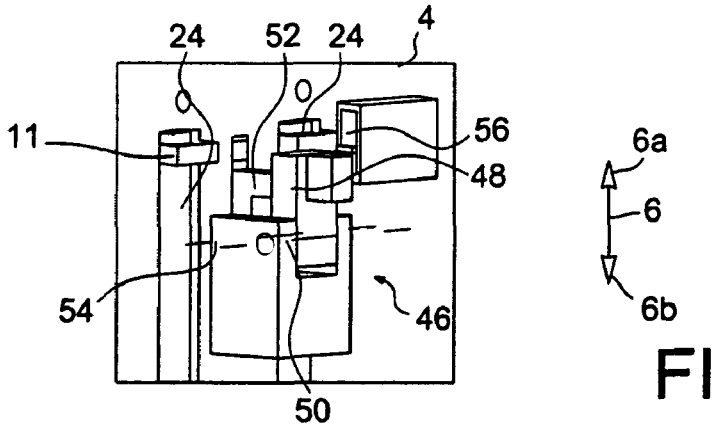

FIG. 13*c*, which shows the holding system in its configuration as taken up when the follower abutment 80 reaches its highest point in the closure direction 6*a*, i.e., as shown in FIG. 12*b*, it can be seen that the moving element 11 has been moved far enough to release the locking ratchet 52 which has thus been able to resume its locking extracted position by means of the action of the return means that are associated therewith, while the support ratchet 48 remains locked in its extracted position due to the pressing exerted by the tilt ratchet 45 on said ratchet 48.

Figure 13D:
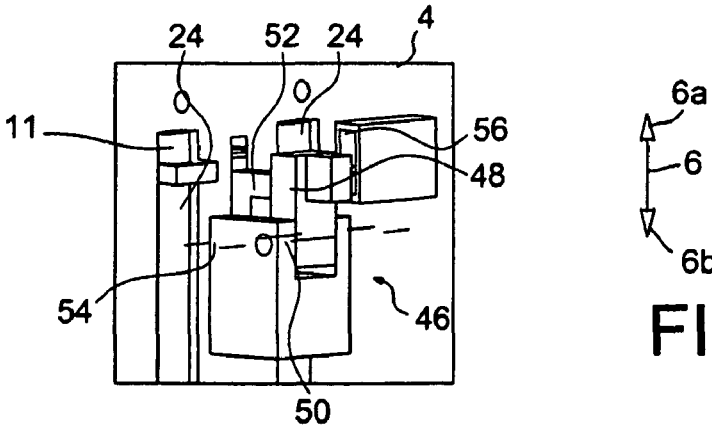

Then, when the moving element 11 and its rods 18 are brought back slightly in the opening direction 6*b* due to the action of the spring 12 and due to the driving abutments 68 retracting into their respective setbacks 84, they are locked in translation in the same direction 6*b* by the locking ratchet 52 coming to constitute an abutment for the element 11 resuming its re-cocked position in which it finds itself in the vicinity of the point P'1, as shown in FIG. 13*d*.

By way of indication, it should be noted that the tilt ratchet 56 is designed to be able to retract when it comes into contact with the support ratchet 48 during the above-described opening stage, naturally for the purpose of not hindering the movement of the moving abutment member 11 going towards its relaxed position.

After the above-presented spring re-cocking stage, when a "close" order is received by the device, a closure stage is initiated that is performed by means of the motor 8, which, via the second transmission means 16 causes the output member 2 to move in the closure direction 6*a*, relative to the frame 4 and relative to the moving element 11 which remains almost always stationary relative to the stationary frame 4, as explained below. In this preferred embodiment, the element 11 remains in its re-cocked position during the closure stage, as shown in FIG. 14, in which it is possible to see that the abutment low end 2*b* has come away from the shock absorber device 20.

During this closure stage, the member 2 is driven in translation in the closure direction 6*a* relative to the stationary element 10 through which it passes, due to the drive abutment 102 being moved by the shaft 32, said drive abutment driving the follower abutment 110 with it along the active portion of the closed line. As shown in FIG. 14, the drive abutment 102 being moved in this way pushes the low end 2*b* of the output member towards the moving element 11. By way of indication, the drive abutment 102 can, in this example, be in the form of two side plates between which the output member 2 (in the form of a connection rod) can be inserted during the closure stage, the two side plates being in abutment with respective ones of the two catches formed by the abutment follower 110, on either side of the output member 2 as shown in FIG. 14. In addition, it should be noted that, throughout the entire moving contact closure stage, the drive abutments 68 are naturally also moved along the passive portions 92 of their respective closed lines 70, without thus ever causing the moving element 11 to move.

Figure 15A:
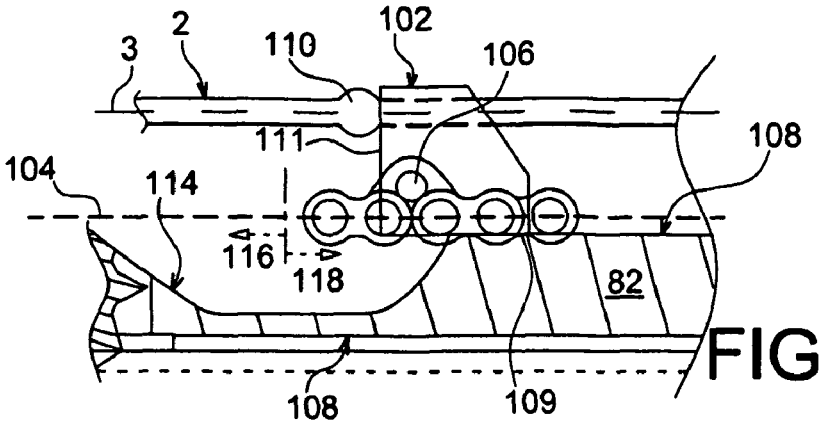
Figure 15B:
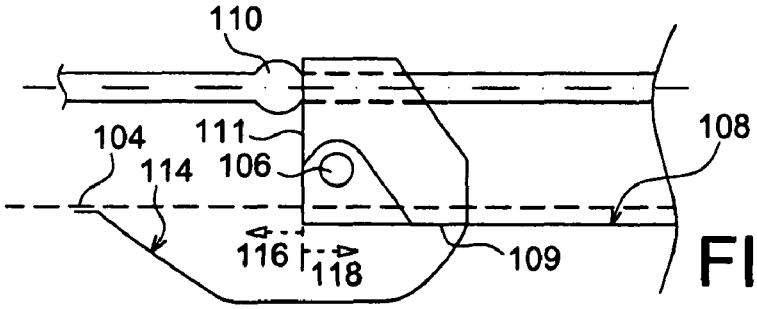
Figure 15C:
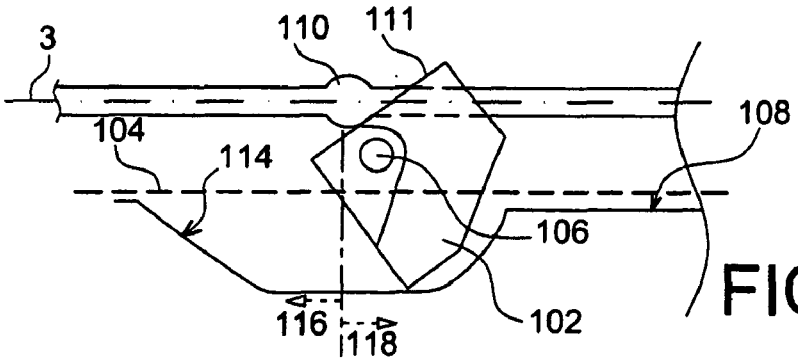

With reference to FIGS. 15*a* to 15*d*, just before the end of the closure stage, the drive abutment 102 having its abutment face 111 in contact with the follower abutment 110 places said follower abutment in a position enabling the member 2 to take up its closure position in which its connection end 2*a* is situated at the point P1. However, the movement of the abutment 102 is not stopped at this stage shown in FIG. 15*a*, but rather it is continued so as to cause said abutment 102 to retract into the setback 114, and thus so as to cause the follower abutment 110 to be released. The abutment 102 moves until it reaches the junction between the active portion 118 and the passive portion 116 of the closed line 104, as shown in FIG. 15*b*. Whereupon, the bearing face 109 of the abutment 102 is no longer bearing against the support track 108, but rather it is in register with the setback 114. It is then the follower abutment 110 (which tends to react in the opening direction 6*b* due to the internal reaction forces of the switchgear, and due to the drive from relaxation of the auxiliary spring 26 (optionally associated with the drive from relaxation of the spring 12) already compressed for absorbing the shock of the end of the closure stroke of the output member) that presses against the abutment 102 while moving, thereby causing said abutment to pivot about the axis 106, and thus causing said abutment 102 to retract into the setback 114 as shown in FIG. 15*c*. By way of indication, the appropriately offset pressing exerted by the follower abutment 110 for the purpose of driving the abutment 102 in rotation about its own axis 106 thus results from said follower abutment 110 being moved in the opening direction 6*b*, but it can also result from the drive abutment 102 continuing to be moved along the passive portion 116 of the closed line 104.

When, under drive from the spring 26 and from the internal reaction forces of the switchgear, the follower abutment 110 resumes its position shown in FIG. 15*a*, enabling the member 2 to take up its closure position, it is totally released form its associated drive abutment 102 retracted inside the setback 114, and held in that position by the system 34 having the ratchet 38 co-operating with the locking abutment 36.

Figure 15D:
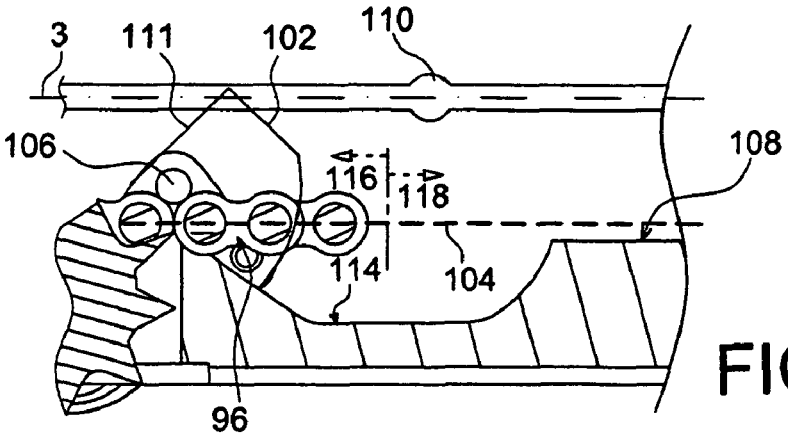

By way of indication, it should be noted that the closure stage can optionally be continued until the abutment 102 has been moved far enough away from the associated follower abutment 110, as shown in FIG. 15*d*, i.e. the motor can remain switched on after the member 2 has reached its closure position. More precisely, the motor can remain switched on until the abutment 102 is moved as shown in FIG. 7, in order to place the apparatus in a good configuration for performing a subsequent opening stage, i.e. in order to arrange the drive abutments 68 at the junctions between the active portions 90 and the passive portions 92.

In which case, the closure stage is performed by moving the drive abutment 102 over its active portion 118, and over a fraction of the passive portion 116, along which the motor opposes no spring return force. Although it is not shown and as appears from above, it is specified that, as from this instant at the end of the closure stage, the drive abutment 68 is preferably situated in contact with its associated follower abutment 80, or in the very close vicinity thereof. In other words, the drive abutment 68 is ready to travel over its active portion 90 for the purpose of initiating subsequent movement of the moving abutment element 11 towards its re-cocked position.

In this preferred embodiment, the system 46 for holding the moving abutment element in the re-cocked position is designed to be deactivated automatically at the end of the closure stage. With reference to FIGS. 16*a* to 16*c*, it is possible to see that, at the end of the moving contact closure stage, resulting in particular in the low end 2*b* of the output member 2 being moved upwards, the locking ratchet 52 holds the moving element 11 in the re-cocked position at the point P'1 (not shown) so long as the low end 2*b* has not come into contact with said moving element 11.

The closure stroke of the output member 2 is determined in a manner such that its low end 2*b* can, at the end of the stroke, drive the moving element 11 with it by abutment over a short distance, in order to release said element from its holding system 46. In FIG. 16*b* showing the holding system in its configuration as taken up once the follower abutment 110 has reached its highest point in the closure direction 6*a*, i.e. as shown in FIG. 15*b*, it is possible to see that the moving element 11 has been moved by abutment far enough so as firstly to release the locking ratchet 52 for locking said element 11, and so as secondly to release the support ratchet 48 from the tilt ratchet 56, said support ratchet 48 having resumed its retracted position by means of the action of the return means that are associated with it. Whereupon, the connection end 2*a* finds itself slightly beyond the point P1 which it has passed, and, similarly, the mobile element 11 finds itself slightly beyond the point P'1 which it has passed, due to it being driven by the low end 2*b*. In addition, the locking system 46 is in a "deactivated" state insofar as its locking ratchet 52 is no longer capable of constituting an abutment for the moving element 11, said moving element being retained in the opening direction 6*b* only, by means of the low end 2*b*, as shown clearly in FIG. 16*b*.

Then, when the output member 2 is brought back slightly in the opening direction 6*b* due to the action of the springs 12 and 26, and due to the drive abutments 102 retracting into their respective setbacks 114, it is locked in translation in said direction 6*b* by the ratchet 38 beyond which the output member has also gone, and which comes to constitute an abutment for the member 2 resuming its closure position in which its connection end 2*a* finds itself at the point P1. Simultaneously, the moving abutment member 11 bearing against the low end 2*b* resumes its re-cocked position in which it finds itself at the point P'1 as in the state shown in FIG. 16*c* also corresponding to the state shown in FIGS. 2 to 5.

Alternatively, it is, in particular, possible to make provision for the system for holding the moving abutment element in the re-cocked position to be of design identical or similar to the design of the above-described system for holding the output member in the closure position, deactivation of it then not being by means of a coil on receiving an electrical instruction, but, but rather, for example, by a mechanical piece that is secured to or integral with the output member, and that is capable of releasing the ratchet at the end of the closure stroke of said output member.

Alternatively, it is possible to make provision for the system for holding the moving abutment element in the re-cocked position to be of design identical to or similar to the design of the above-described system for holding the output member in the closure position, deactivation of it then not being by means of a coil on receiving an electrical instruction, but rather, for example, by a mechanical piece that is secured to or integral with the output member, and that is capable of mechanically releasing the ratchet on receiving the instruction to open the moving contact, thereby simultaneously causing the system for holding the output member in the closure position to be deactivated.

In yet another alternative, it is possible to make provision for the system for holding the moving abutment element in the re-cocked position to be of design identical to or similar to the design of the above-described system for holding the output member in the closure position, deactivation of it then being by means of a coil on receiving an electrical instruction transmitted at the same time as the instruction to open the moving contact, simultaneously causing the system for holding the output member in the closure position to be deactivated. In which case, the coils are then arranged in series in order to obtain simultaneous deactivation. Or indeed, the coils are arranged in a circuit so that, for a single "open" instruction transmitted, the coil serving to deactivate holding the moving abutment element in the re-cocked position acts an instant before the coil serving to deactivate holding the output member in the closed position.

With reference jointly to FIGS. 17 and 18, it is possible to see a portion of the control apparatus 1 that includes a system 46 for holding the moving abutment element 11 in the re-cocked position, in an even more preferred embodiment of the present invention.

More precisely, with reference to FIG. 17, the system 46 shown in part only comprises two similar entities 73, each of which co-operates with a respective one of the two rods 18, so as to hold it relative to the stationary element 10 when the moving abutment element 11 finds itself in the re-cocked position. It is one of these two entities 73 that is shown diagrammatically in FIG. 18, with the mobile element 11 (not shown) being in the re-cocked position.

It can be seen that each entity 73 includes a ratchet 39 hinged about an axis 43 to the frame 4, and more specifically to an extension 75 of the stationary element 10, extending downwards relative thereto. In the activated configuration as shown and taken up when the moving abutment element is in its re-cocked position, the ratchet 39 is held pressed against a locking abutment 37 hinged about an axis 77 to its associated rod 18, thereby preventing the rod 18 and thus the element 11 from moving in the opening direction 6*b* relative to the frame 4. As can be seen in the figures, the bottom end of the abutment 37 in fact bears against a roller 79 carried by the ratchet 39, said roller 79 being mounted about an axis 81 that is parallel to the above-mentioned axes 43 and 77. In order to lock the ratchet 39 in the position shown in the figures, firstly a locking piece 41 is provided, the two locking pieces 41 that serve to equip respective ones of the two entities 73 being secured to each other, by means of a shaft 83 at the ends of which the pieces 41 are carried rigidly. The shaft 83 is hinged at its two ends to respective ones of the two extensions 75 of the frame, as can be seen in FIG. 17. Each piece 41 then has a first extension 85 bearing against an end of the ratchet 39 that is opposite from the end via which it is hinged about the axis 43.

In addition, a lever 47 is also provided that is hinged relative to the stationary element 10 about an axis 45 and retained in the activated holding position by a spring 87 as shown in FIG. 18, in which holding position a low end 89 of said lever 47 bears against a second extension 91 of the locking piece 41.

At the end of the closure stage of the moving contact, the lever 47 is moved automatically and releases the locking pieces 41 from the entities 73 which retract, and which in turn release the ratchets 39. To this end, as can be seen more clearly in FIG. 18, it is indicated that the bearing face of the locking abutment 37 has a certain angle relative to the axes of the rods 18, thereby generating a force 101 via the spring 12 that makes it possible, while the lever 47 is moving, to push the ratchet 39 which itself is capable of pushing the locking piece 41 released by the lever 47 at its second extension 91. Thus, the piece 41 subjected to the force 103 by the ratchet 39 can disengage from the lever 47, while the ratchet 39 can disengage from the locking piece 41 which is hinged relative to the frame about an axis 93 that is parallel to the axis 45 and to the other above-mentioned axes.

In this deactivated configuration (not shown) encountered at the end of the closure stage, the locking abutments 37 find themselves free, and the rods 18 secured to the moving element 11 can then move in the direction 6*b* under drive from the spring 12 until the moving element 11 is stopped by the bottom end 2*b* of the output member 2 that finds itself in the closure position.

During a re-cocking stage of the opening spring 12, involving the moving element 11 and the rods 18 being moved in the upwards direction 6*a*, the first elements of the system 46 that come into operation are the locking abutments 37 which progressively establish contact with the ratchets 39 as they go back up. Each abutment 37 held in the extracted position by a spring 95 then folds back progressively towards the axis of the rod 18 to which it is hinged, i.e. clockwise as seen in FIG. 18, this folding back thus resulting from the bearing force with which the roller 79 of the ratchet 39 bears against the corresponding locking abutment 37, opposing the force of the spring 95.

Once it has gone past the roller 79, the abutment 37 tends to resume its extracted position under drive from the spring 95, and thus moves counterclockwise. Thus, its angle with the axis of the rod 18 increases again.

Then, the drive abutment 68 that can be seen in particular in FIG. 9 retracts and releases the follower abutment 80, and thus the rod 18. The moving abutment member 11, as pushed by the spring 12, and the rods 18 move back down until the abutments 37 bear stably on the roller 79 of the ratchets 39. As shown in FIG. 18, the abutment 37 pushes the ratchet 39 towards the first extension 85 of the locking piece 41 which, in turn, sees its second extension 91 pushed towards the lever 47, itself pressed against a stationary abutment 105 of the frame 4 by the return spring 87.

In this even more preferred embodiment, the system for holding the moving element in the re-cocked position 46 is designed to deactivate automatically at the end of the above-described closure stage, but preferably after the output member 2 has reached its closure position.

At the end of the closure stage, a special link 49 of the chain 62 comes to push a high end 97 of the lever 47 which then pivots by opposing the return force of the spring 87, and thus releases the two locking pieces 41 from the two entities 73, by means of contact being broken between the low end 89 of the lever and the second extension 91. With the locking pieces 41 having been released in this way, said pieces 41 and the ratchets 39 pivot clockwise in FIG. 18, resulting from the bearing forces 101 and 103. Therefore, after the ratchets 39 have pivoted, the locking abutments 37 are released. In this configuration (not shown) that is taken up at the end of the closure stage after the output member 2 has reached its closure position, the system 46 for holding the moving element in the re-cocked position then finds itself deactivated.

The action of the special link 49 of the chain 62 on the lever 47 is synchronized just after the drive abutment 102 retracts, i.e. just after it enters the passive portion 116, as seen in FIG. 15*c*. Thus, the motor has to deliver this force for moving the lever 47, however small, only after having finished its task of putting the output member 2 in the closure position. In this even more preferred embodiment using a special chain link for driving deactivation of the holding system 46 by abutment, the motor thus never acts on both springs 12 and 26 simultaneously, thereby advantageously making it possible to optimize it. In addition, synchronization between the special link 49 and the drive abutment 102 is possible because the chains 62 and 96 of the first and second drive means are designed to move in phase with one another.

At the time when the rods 18 are released by the holding system 46, the moving abutment element 11 of the spring moves to a small extent in the direction 6*b* under drive from the spring 12, until it comes into contact with the bottom end 2*b* of the output member 2, to which it is very close at that time. Since the drive abutment 102 is already in the passive portion, the locking abutment 36 fastened to the output member 2 has gone past the holding system 34, and the output member 2 thus stops in its stable position in which its top end 2*a* is situated at the point P1. The moving abutment element 11 thus remains in the re-cocked position P'1 or in the vicinity thereof, although the holding system 46 is deactivated.

On receiving another "open" instruction, the closed position holding system 34 is desactivated, and the spring 12 and 26 drive the moving element 11 and the low end 2*b* of the output member in the direction 6*b* towards moving contact opening. Thus, the only holding to be released on opening is the holding associated with the system 34 for holding the member 2, thereby offering greater operating reliability.

Naturally, various modifications can be made by the person skilled in the art to the control apparatus 1 which is described above only by way of non-limiting example.

The invention claimed is:

1. Control apparatus for controlling electrical switchgear that has a moving contact suitable for taking up a closed position and an open position, said control apparatus being designed to move said moving contact, and comprising a stationary frame, and an output member that is mounted to move in translation relative to said stationary frame and that has a connection end for connection to the moving contact, the apparatus further comprising at least one motor and an opening mechanical spring received between an element fastened to said frame and a moving abutment element, said output member being suitable for taking up a closure position which makes it possible to place the moving contact in its closed position and in which the connection end for connection to the moving contact is situated at a point P1, and an opening position which makes it possible to place the moving contact in its open position and in which the connection end for connection to the moving contact is situated at a point P2 distinct from P1;

said control apparatus being characterized in that it is designed such that it is capable of performing the following in succession:

during an opening stage for opening the moving contact, causing the connection end for connection to the moving contact to go from the point P1 to the point P2, under the effect of said opening mechanical spring moving said moving abutment element that drives said output member by abutment;

during a re-cocking stage for re-cocking the opening mechanical spring, moving said moving abutment element under the effect of switching on said at least one motor, while keeping the connection end for connection to the moving contact at the point P2; and during a closure stage for closing the moving contact, causing the connection end for connection to the moving contact to go from the point P2 to the point P1, also under the effect of switching on said at least one motor.

2. Control apparatus according to claim 1, characterized in that it is designed so that, during the closure stage for closing the moving contact, resulting in said connection end for connection to the moving contact moving from the point P2 to the point P1, the energy stored in the opening mechanical spring does not vary.

3. Control apparatus according to claim 1, characterized in that it is designed so that said opening stage for opening the moving contact, resulting in said connection end for connection to the moving contact moving from the point P1 to point P2, is performed solely under the effect of said opening mechanical spring.

4. Control apparatus according to claim 1, characterized in that it further comprises first transmission means interposed between said at least one motor and said moving abutment element, said first transmission means comprising at least one transmission assembly provided with a drive abutment organized to be moved along a closed line, said closed line having an active portion along which said drive abutment is capable of driving a follower abutment secured to said moving abutment element for the purpose of bringing said moving abutment element from a relaxed position to a re-cocked position, and a passive portion along which said drive abutment, since it not longer acts on the associated follower abutment, allows said moving abutment element to go from the re-cocked position to the relaxed position.

5. Control apparatus according to claim 4, characterized in that said transmission assembly further comprises a chain or a belt carrying said drive abutment and following said closed line, said chain or belt being arranged between two wheels, at least one of which is driven in rotation by said at least one motor.

6. Control apparatus according to claim 5, characterized in that said transmission assembly further comprises a drive abutment support track engaged closely by said drive abutment carried by said chain or belt.

7. Control apparatus according to claim 6, characterized in that said drive abutment support track is provided with a setback into which said drive abutment mounted to be free to pivot on said chain or belt is designed to retract automatically by pivoting, when said drive abutment leaves the active portion of said closed line.

8. Control apparatus according to claim 7, characterized in that it is designed so that said drive abutment retracts automatically into the setback by said follower abutment bearing against said drive abutment, thereby tending to cause said drive abutment to pivot about its pivot axis relative to said chain or belt.

9. Control apparatus according to claim 4, characterized in that said follower abutment is arranged at the end of a rod whose other end is secured to said moving abutment element.

10. Control apparatus according to claim 1, characterized in that it further comprises second transmission means interposed between said at least one motor and said output member, said second transmission means comprising at least one transmission assembly provided with a drive abutment organized to be moved along a closed line, said closed line having an active portion along which said drive abutment is capable of driving a follower abutment secured to said output member for the purpose of bringing said output member from said opening position to said closure position, and a passive portion along which said drive abutment allows said output member to go from the closure position to the opening position.

11. Control apparatus according to claim 10, characterized in that said transmission assembly further comprises a chain or a belt carrying said drive abutment and following said closed line, said chain or belt being arranged between two wheels, at least one of which is driven in rotation by said at least one motor.

12. Control apparatus according to claim 11, characterized in that said transmission assembly further comprises a drive abutment support track engaged closely by said drive abutment carried by said chain or belt.

13. Control apparatus according to claim 12, characterized in that said drive abutment support track is provided with a setback into which said drive abutment mounted to be free to pivot on said chain or belt is designed to retract automatically by pivoting, when said drive abutment leaves the active portion of said closed line.

14. Control apparatus according to claim 13, characterized in that it is designed so that said drive abutment retracts automatically into the setback by said follower abutment bearing against said drive abutment, thereby tending to cause said drive abutment to pivot about its pivot axis relative to said chain or belt.

15. Control apparatus according to claim 10, characterized in that said first and second transmission means are driven by said at least one motor, which is constituted by a single motor.

16. Control apparatus according to claim 15, characterized in that said single motor is a servomotor.

17. Control apparatus according to claim 1, characterized in that it further comprises a system for holding said moving abutment element in the re-cocked position, and a system for holding said output member in the closure position.

18. Control apparatus according to claim 17, characterized in that it is designed so that said system for holding said moving abutment element in the re-cocked position is deactivated at the end of the closure stage of the moving contact.

19. Control apparatus according to claim 17, characterized in that it is designed so that said system for holding said moving abutment element in the re-cocked position and said system for holding the output member in the closure position are deactivated substantially simultaneously when said opening stage of the moving contact is initiated.

20. Control apparatus according to claim 17, characterized in that it is designed so that said system for holding said moving abutment element in the re-cocked position is deactivated after said output member has reached its closure position.

21. Control apparatus according to claim 1, characterized in that it is designed so as to deliver a linear output movement.

22. Control apparatus according to claim 1, characterized in that said moving abutment element is mounted to slide relative to said output member which passes through said moving abutment element, along a sliding axis that is identical to the axis along which said output member moves in translation relative to the stationary frame.

23. Control apparatus according to claim 1, characterized in that said opening mechanical spring is arranged around said output member.

24. Control apparatus according to claim 1, characterized in that it further comprises an auxiliary mechanical spring for absorbing the shock of the end of the closure stroke of said output member.

25. Control apparatus according to claim 1, characterized in that it further comprises an auxiliary mechanical spring for absorbing the shock of the end of the opening stroke of the output member.

26. Electrical switchgear having a moving contact suitable for taking up a closed position and an open position, said electrical switchgear being characterized in that it includes control apparatus according to claim 1.

27. A method of controlling electrical switchgear, said method being characterized in that it is implemented by means of control apparatus according to claim 1, said method comprising the following successive steps:

opening the moving contact under the effect of the opening mechanical spring moving said moving abutment element that drives said output member by abutment, so as to cause the connection end for connection to the moving contact to move from the point P1 to the point P2;

re-cocking the opening mechanical spring under the effect of switching on said at least one motor that causes said moving abutment element to move, and while keeping the connection end for connection to the moving contact at the point P2; and closing the moving contact, also under the effect of switching on said at least one motor, so as to cause the connection end for connection to the moving contact to move from the point P2 to the point P1.

* * * * *